US009486020B2

(12) United States Patent
Arora et al.

(10) Patent No.: US 9,486,020 B2
(45) Date of Patent: Nov. 8, 2016

(54) DAILY-USE GARMENT THAT CONVERTS INTO A PERSONAL FLOTATION DEVICE

(71) Applicants: Rohan Arora, South Riding, VA (US); Rahul Busayavalasa, South Riding, VA (US); Prasan Chari, South Riding, VA (US); Caroline Maloney, South Riding, VA (US); Grace Maloney, South Riding, VA (US); Satya Paruchuri, South Riding, VA (US); Connor Patterson, South Riding, VA (US); Samantha Steadman, South Riding, VA (US)

(72) Inventors: Rohan Arora, South Riding, VA (US); Rahul Busayavalasa, South Riding, VA (US); Prasan Chari, South Riding, VA (US); Caroline Maloney, South Riding, VA (US); Grace Maloney, South Riding, VA (US); Satya Paruchuri, South Riding, VA (US); Connor Patterson, South Riding, VA (US); Samantha Steadman, South Riding, VA (US)

( * ) Notice: Subject to any disclaimer, the term of this patent is extended or adjusted under 35 U.S.C. 154(b) by 151 days.

(21) Appl. No.: 14/518,012

(22) Filed: Oct. 20, 2014

(65) Prior Publication Data

US 2015/0223527 A1 Aug. 13, 2015

Related U.S. Application Data

(60) Provisional application No. 61/939,319, filed on Feb. 13, 2014.

(51) Int. Cl.

| | |
|---|---|
| ***B63C 9/08*** | (2006.01) |
| ***A41D 13/012*** | (2006.01) |
| ***A41D 3/00*** | (2006.01) |

(52) U.S. Cl.

CPC ..... *A41D 13/0125* (2013.01); *A41D 3/005* (2013.01); *A41D 2200/20* (2013.01)

(58) Field of Classification Search

CPC ..... B63C 9/081; B63C 9/18; A41D 13/0125

See application file for complete search history.

(56) References Cited

U.S. PATENT DOCUMENTS

| | | | | |
|---|---|---|---|---|
| 4,753,621 | A | 6/1988 | Lucas et al. | |
| 6,314,579 | B1 * | 11/2001 | Marcon | A41D 13/0012 2/102 |
| 6,374,418 | B1 | 4/2002 | Rindle | |
| 6,447,353 | B1 | 9/2002 | Henry | |
| 6,659,825 | B2 | 12/2003 | Foss | |
| 6,681,399 | B1 * | 1/2004 | Kerr | A41D 13/0125 2/2.5 |
| 7,302,710 | B2 | 12/2007 | Thomas et al. | |
| 7,917,970 | B2 | 4/2011 | Shimshony | |

OTHER PUBLICATIONS

Garmin Chirp Owner's Manual, Sep. 2010, 190-01276-00 Rev. C (pp. 1-2).

Garmin International, Declaration of Conformity, J. Wiltshire, Apr. 1, 2011 (pp. 1-6).

(Continued)

*Primary Examiner* — Stephen Avila

(74) *Attorney, Agent, or Firm* — Oblon, McClelland, Maier & Neustadt, L.L.P.

(57) ABSTRACT

A daily-use garment that is substantially normal in appearance includes a head portion corresponding to a head region of a person, and a body portion corresponding to a torso of the person. The head region is configured to cover the head region of the person with a first flexible chamber positioned in the head portion. A second flexible chamber is positioned in the body portion. A fluid supply device of the daily-use garment includes a container configured to hold a fluid under pressure, a first activation member configured to open the container, and one of a conduit and a nozzle that supplies the fluid from the container. The fluid supply device opens the container and supplies the fluid to at least one of the first flexible chamber and the second flexible chamber, and the daily-use garment is converted from a first state to a second state.

20 Claims, 22 Drawing Sheets

(56) References Cited

OTHER PUBLICATIONS

Secumar—Secumatic 3001S/Secumar 301SM, fall 2013, (www.secumar.com, pp. 1-57).
Secumar—Secumatic 4001S/Secumatic 401S, fall 2013, (www.secumar.com, pp. 1-57).
Secumar—Secumatic 4001S manual override, fall 2013, (1 page).
Halkey-Roberts Corporation, PRO 1F® Manual/Automatic Inflator, fall 2013, (www.halkeyroberts.com, pp. 1-2).
Halkey-Roberts Corporation, Alpha Inflator® Manual/Automatic, fall 2013, (www.halkeyroberts.com, pp. 1-4).
Halkey-Roberts Corporation, PRO 3F® Manual inflator, fall 2013, (www.halkeyroberts.com, pp. 1-2).
Hammer® Better Solutions for Safety at Sea—M1A1/EC, C.M. Hammer AB, fall 2013, (www.cmhammer.com, pp. 1-26).
Aegis, Lifeshirt®, Summer 2016 (https://www.facebook.com/GIGadgets.Fans/videos/1058496084229680/, pp. 1-41 correspond to screenshots from the video of the Lifeshirt available at this link).

* cited by examiner

DAILY-USE GARMENT THAT CONVERTS INTO A PERSONAL FLOTATION DEVICE

CROSS-REFERENCE TO RELATED APPLICATIONS

This application is based upon and, pursuant to 35 U.S.C. §119(e), claims the benefit of priority from Provisional Patent Application No. 61/939,319, filed on Feb. 13, 2014; the entire contents of which are incorporated herein by reference.

BACKGROUND OF THE DISCLOSURE

Field of the Disclosure

The present disclosure relates to garments, such as hooded sweatshirts or jackets, that may be worn on a daily basis, and may be converted from a normal state to a personal flotation device in an activated state.

Conventional personal flotation devices may have outward appearances, and/or may provide limited body coverage, not considered desirable and/or adequate for daily use. However, natural disasters or major weather events such as hurricanes, flash floods, tornadoes, or the like, may occur unexpectedly, and create an immediate need for emergency items such as a flotation device, tools, and/or rations of food and water. Further, as a result of these events, individuals may be displaced from known locations, or may be lost in more serious situations. Such urgent situations may be accompanied by continued weather conditions resulting in impaired visibility for search and rescue personnel attempting to find and help lost or injured individuals. Thus, a need exists for a garment that is visually acceptable for daily use, suitable to be worn during activities in the normal course of a person's daily routine, and capable of providing a personal flotation device on demand. In addition, there exists a need for a garment that includes tracking/or transmitting devices, and/or has an outward appearance which increases the chances of an individual being found by search and rescue personnel.

SUMMARY OF THE DISCLOSURE

In one aspect of the present disclosure, a garment is provided which converts between a first state providing a garment substantially normal in appearance and suitable for daily-use, and a second state providing a personal safety device suitable for supporting a wearer in a body of liquid such as water, so that at least a head of the wearer remains above a surface of the body of liquid. An automatic conversion mechanism including a valve, a container of pressurized fluid, and an actuator may be included with garment. The actuator may automatically open the container in response to contact with a portion of the body of liquid for a predetermined amount time, so that the pressurized fluid mechanically converts the garment from the first state to the second state.

In another aspect of the present disclosure, a daily-use garment with flotation capabilities and that is substantially normal in appearance is provided. A head portion of the daily-use garment may correspond to and be configured to cover a head region of the wearer, and a body portion may correspond to a torso of the wearer. A first flexible chamber may be positioned in the head portion, and a second flexible chamber may be positioned in the body portion. The daily-use garment may include a first fluid supply device with a container configured to hold a portion of fluid under pressure, a first activation member configured to open the container, and one of a conduit and a nozzle that supplies the fluid from the container. In one aspect of the daily-use garment, the first activation member automatically opens the container and the first fluid supply device supplies the first fluid to at least one of the first flexible chamber and the second flexible chamber and the daily-use garment is converted from a normal state to an activated state. The daily-use garment is capable of providing a personal flotation device in the activated state.

In another aspect of the present disclosure, a daily-use garment includes a head portion corresponding to a head region of a wearer, a body portion corresponding to a torso of the wearer, a first layer forming an inner garment layer of the head portion and the body portion, and a second layer forming an outer garment layer of the head portion and the body portion. The daily-use garment may include a first flexible chamber positioned in the head portion between the first layer and an interior side of the second layer, and a second flexible chamber positioned in the body portion between the first layer and the interior side of the second layer. A first fluid supply device may be provided, and may include a container configured to hold a portion of a fluid under pressure, a first activation member configured to open the container, and one of a conduit and a nozzle that supplies the first fluid from the container. In one aspect, a pull string may be provided with a first end extending from the head portion and a second end attached to an arm of a second activation member of the first fluid supply device. The first activation member may automatically open the container, or a first end of the pull string may be pulled on an outside of the head portion to move the arm of the second activation member and open the container. The container may be opened and the first fluid supply device supplies the fluid to at least one of the first flexible chamber and the second flexible chamber, and the daily-use garment is converted from a normal state into a personal flotation device.

BRIEF DESCRIPTION OF THE DRAWINGS

A more complete appreciation of embodiments of the disclosure and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1B:
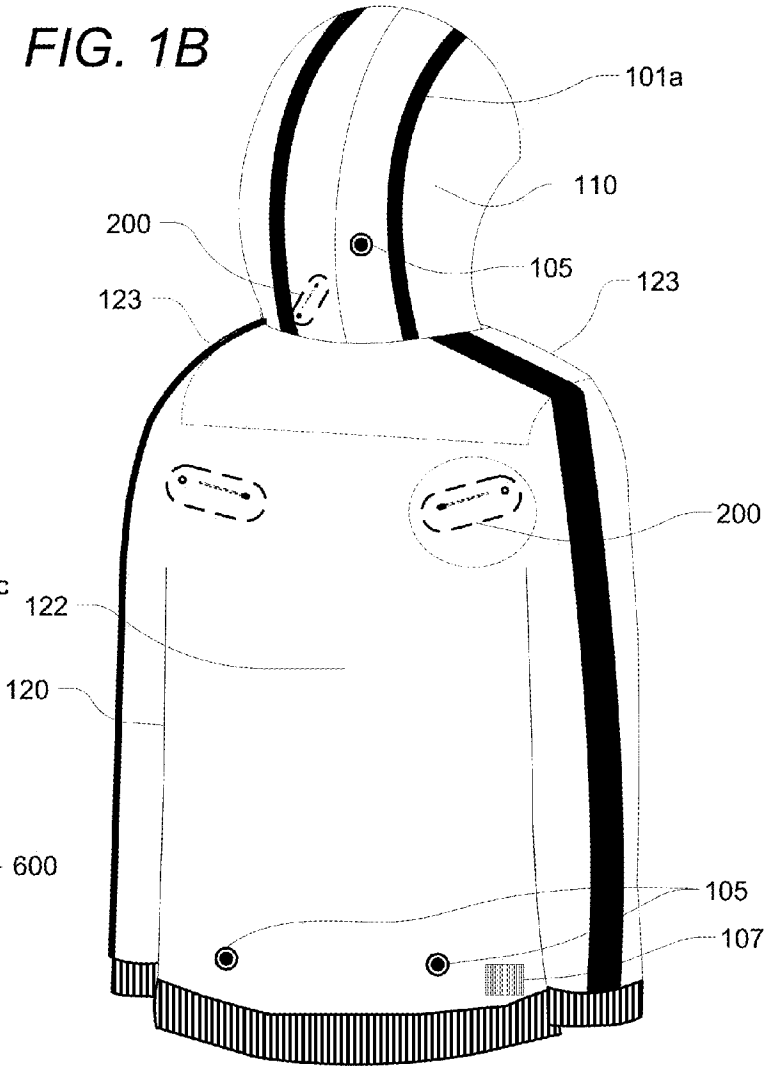
FIGS. 1A-1C are perspective views of a front and a back of a daily-use garment that converts between a normal state and an activated state according to an embodiment of the present disclosure.

Referring now to the drawings, wherein like reference numerals designate identical or corresponding parts throughout the several views of a daily-use garment that converts between a normal state and an activated state according to the present disclosure.

The following description relates to a daily-use garment that is substantially normal in appearance, at least in a normal state. According to the present disclosure, "daily-use garment" will generally refer to an article of clothing that is suitable for everyday wear. Further, a garment that is "substantially normal in appearance" will be defined as a garment having a general shape and form of a typical article of clothing, such as a typical hooded sweatshirt or jacket, or common variations of typical articles of clothing (e.g. a sleeve-less hooded sweatshirt, or hooded vest, for example), and for which it is not readily discernable that the garment is a flotation device.

Further, the present disclosure relates to a daily-use garment that rapidly changes/converts from a normal state to an activated state, and thereby provides a personal safety device capable of maintaining at least a head of a person wearing the daily-use garment above a surface of liquid surrounding the person. A conversion of the daily-use garment according to the present disclosure can be accomplished automatically or manually with an inflation device including a pressurized source of fluid inside of the daily-use garment, or manually by a person externally supplying fluid to the daily-use garment.

Figure 1A:
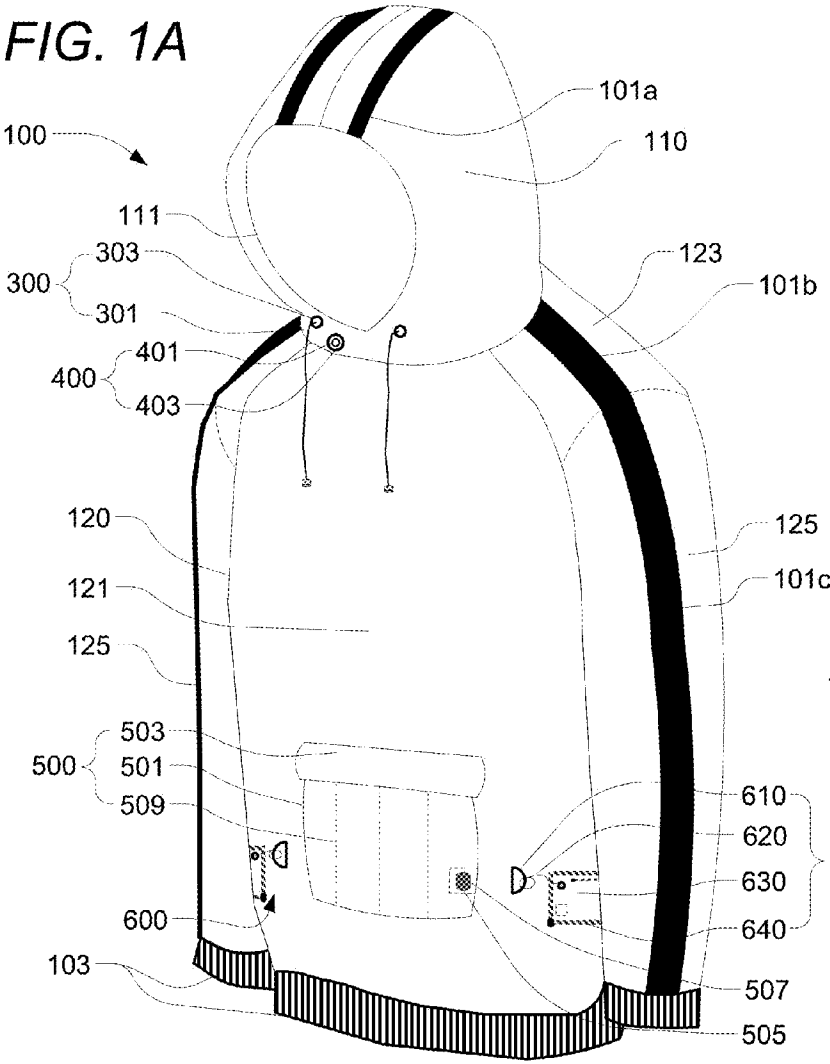

FIGS. 1A and 1B illustrate perspective views of a daily-use garment 100 according to the present disclosure. The daily-use garment 100 includes a head portion 110, such as a hood, extending from a body portion 120 between shoulder sections 123. A hood opening 111 is provided in the head portion 110, from which a face of a person would be visible if the person wearing the daily-use garment 100 covers his/her head with the hood 110. The body portion 120 is positioned between arms 125 that extend downward from the shoulder sections 123. The daily-use garment 100 includes a front side 121 and a back side 122.

As illustrated in FIGS. 1A and 1B, a plurality of reflective strips 101, including head reflective strips 101*a*, shoulder reflective strips 101*b*, and arm reflective strips 101*c* are provided on an exterior of the daily-use garment 100. The locations for the reflective strips 101 are not limited to the head portion 110, shoulder sections 123, and arms 125, and may be located in any area of the daily-use garment 100 that may be advantageous for spotting a person surrounded by a body of liquid such as water. The locations for the reflective strips 101 ideally correspond to those areas most visible to search and rescue efforts involving shining a light from a boat or airborne vehicle such as a helicopter, onto a surface of a body of liquid after a natural disaster, such as a flash flood, hurricane, tsunami or the like, or an accident at sea, a river, or a lake, for example, where individuals may be lost amidst large bodies of water. The reflective strips 101 would also be advantageous for search and rescue efforts for finding individuals on land in large wooded areas or after major weather events, such as a tornado where damage to buildings and other debris make finding individuals difficult.

Each reflective strip 101 is formed from a high visibility fabric (such as 3M™ Scotch™ Reflective Material fabric or tape, or reflective polyester tape, for example) that is reflective when light is directed thereon. In exemplary embodiments of the daily-use garment 100, the head portion 110 and the body portion 120 can be formed from a non-permeable, and more preferably water proof material (such as Gore-Tex®), that may also have reflective properties. In some exemplary embodiments, the material for the head portion 110 and the body portion 120 may be less reflective than the reflective strips 101, in order to provide an outward appearance considered to be more appealing for everyday use (e.g. visually acceptable for times when a natural disaster is not eminent or even remotely predicted to occur). Such material may include nylon or ripstop (polyurethane or silicone coated) fabrics, for example. In other exemplary embodiments of the daily-use garment 100 which are regularly worn by emergency personnel who are routinely involved in search and rescue efforts, each of the head portion 110, body portion 120, and reflective strips 101 can be made from materials having substantial reflective properties.

It will be understood that locations of the reflective strips 101, and levels of reflectiveness for the head portion 110, body portion 120, and the reflective strips 101, may be selected based on fashion trends, and/or overall advantages to be provided by the exterior of the daily-use garment 100 in emergency situations. Thus, in some exemplary embodiments of the daily-use garment 100, each of the reflective strips 101 may be formed from a respective material having different reflective properties than materials of the other reflective strips 101. For example, the head reflective strips 101*a* may be formed from a more reflective (e.g. brighter) material than the shoulder reflective strips 101*b* and/or the arm reflective strips 101*c*. During normal use in a non-emergency situation, the head portion 110 may be retracted from covering an individual's head, and the head reflective strip 101*a* not fully expanded. Thus, a respective reflective material, which is more reflective (e.g. brighter) than all other portions of the daily-use garment, is less pronounced to help to maintain a more conservative outward appearance of the daily-use garment 100. Concurrently, the head portion 110 may also be the most visible aspect of an individual who is floating in body of water with head portion 110 deployed over the person's head.

Figures 1C, 2, 3:
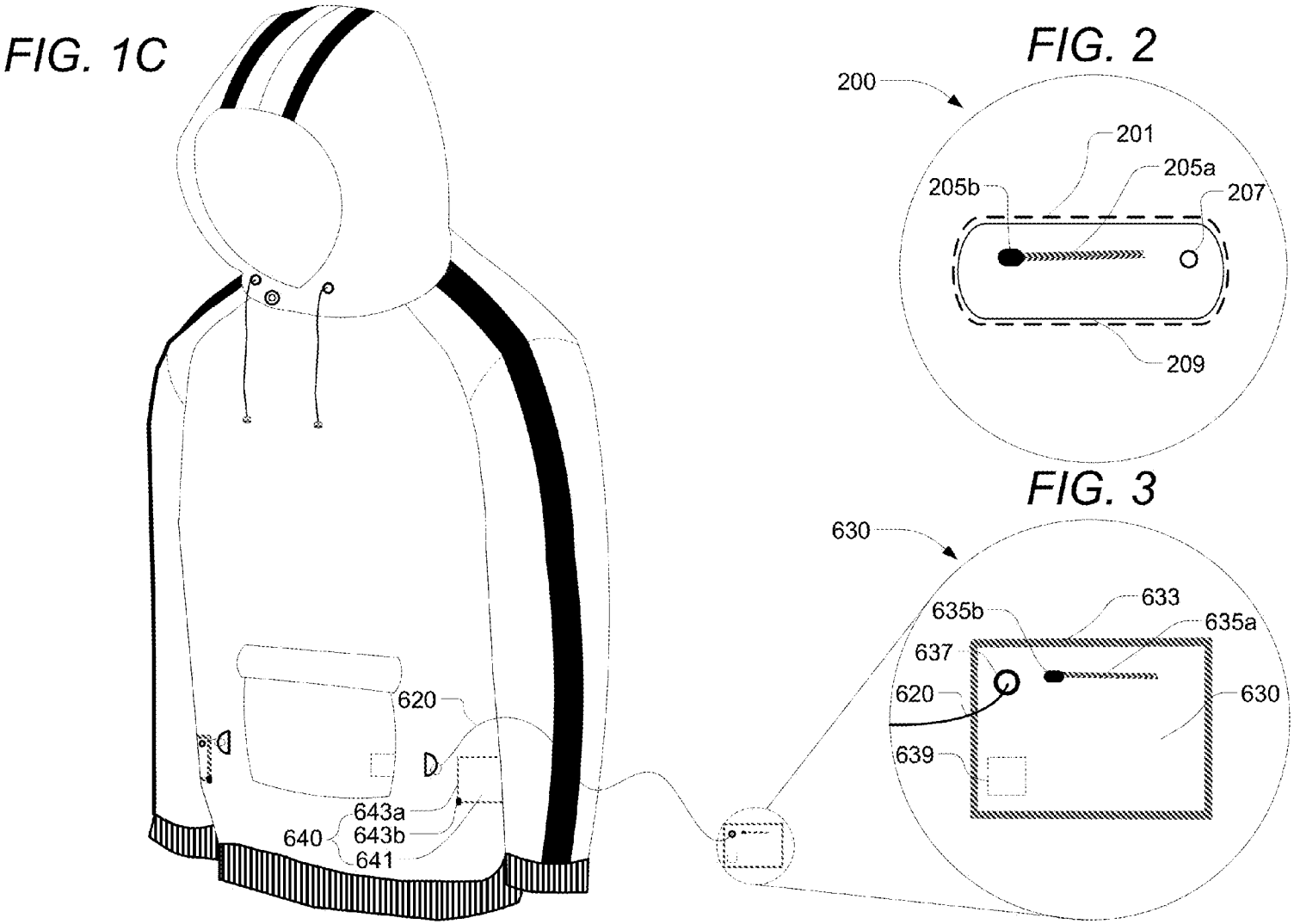
FIG. 2 is a close up view of a rapid inflation system according to an embodiment of the present disclosure.
FIG. 3 is a close up view of a detachable pocket according to an embodiment of the present disclosure.

With regard to materials of the daily-use garment 100, materials used to form the head portion 110 and the body 120 are preferably flexible and elastic so as to provide a garment that can be worn by individuals of different sizes. In addition, as illustrated in FIGS. 1A-1C, elastic bands 103 are provided on the body portion 120 and the arms 123 in locations corresponding to both wrists and a waist of an individual. Thus, the elastic bands 103 maintain the daily-use garment 100 in a tight-fitting orientation on a person who wears the daily-use garment 100.

As illustrated in FIGS. 1A, 1B, and 1C, the exterior of the daily-use garment 100 includes a relief valve 105, a bar code 107, and parts of rapid inflation systems 200, a first manual activation system 300, a second manual activation system 400, an emergency storage pocket 500, and a detachable pocket system 600. FIG. 1B illustrates the back side 122 of the daily-use garment 100, which includes the relief valves 105, the bar code 107, and parts of each rapid inflation system 200. The relief valves 105 can be operated from an outside of the daily-use garment 100 to release fluid supplied to chambers to be described later. The relief valves 105 may be similar to valves used to manually blow up an inflatable raft or mattress. Thus, the relief valves 105 may include one-way valves that can be operated by hand to open and release fluid, or used to supply fluid from outside the daily-use garment 100 and maintain fluid in a chamber.

The bar code 107 may be located on a bottom of the body portion 120 on an exterior of the back side 122, and associated with information of an individual owning the daily-use garment 100. Such information can be provided through a registration system at the time of purchase or afterwards, associated with a bar code 107 that is unique to a respective daily-use garment 100 owned by the individual, and provided to local and state authorities. Such information regarding the purchaser/owner can be sent to local and state authorities and grouped with information related to the purchaser/owner's family. An advantage of providing a record of the purchaser/owner is that if a member of a family wearing the daily-use garment 100 is found after an emergency situation, the bar code can be scanned and information regarding the individual's location can be sent to other members of the family. Information regarding the history of use (e.g. times and dates when the daily-use garment 100 was converted from the normal state to the activated state, or type of rapid inflation systems compatible with the daily-use garment 100, for example) can be uploaded to a database and accessed by local authorities and family members. In addition, the information may be updated automatically when the daily-use garment 100 is converted from the normal state to the activated state, and local authorities alerted.

As illustrated in FIG. 1B, the back side 122 includes two rapid inflation systems just below the shoulder sections 123 and between the arms 125, and may include one rapid inflation system 200 on the head portion 110. Parts of an exemplary rapid inflation system 200 visible from the outside of the daily-use garment 100 as illustrated in FIG. 1B, are shown in more detail in FIG. 2. A wall 209 of the rapid inflation system 200 is attached to the daily-use garment 100 at a seam 201. The rapid inflation system 200 includes a closable access 205*a*, and an opening/closing device 205*b*. In exemplary embodiments of the rapid inflation system 200, a combination of the closable access 205*a* and the opening/closing device 205*b* may include opposing sides of teeth and a slider of a zipper respectively, hook and loop Velcro strips, snap fasteners, or other devices used to repeatedly fasten together and unfasten articles of clothing. The rapid inflation system 200 also includes an inlet/vent 207 which allows fluid, including a liquid capable of causing an automatic actuation of the rapid inflation system 200 as discussed below, to enter into an inner compartment defined by the wall 209.

As illustrated in FIGS. 1A and 1C, the front side 121 of the daily-use garment 100 includes parts of the first manual activation system 300 and the second manual activation system 400, which are visible from the outside of the daily-use garment 100. The first manual activation system 300 includes a cord opening 303 positioned on each side of the head portion 110, and a drawstring or cord 301 (hereafter referred to as a "cord 301") that extends through each cord opening 303. In exemplary embodiments illustrated herein, a separate cord 301 is provided through each cord opening 303, however it will be understood that the first manual activation system 300 may include a single cord 301 that connects on the back side 122 of the daily-use garment 100 in the head portion 110. Pull-tabs 301*a* are provided on ends of the cord 301, and as will be explained, can be used to manually convert the daily-use garment 100 from the normal state to the activated state. The second manual activation system 400 includes an inflation tube opening 403 also located on the head portion 110. A tube 401 is accessible from the inflation tube opening 403 and can be used to convert the daily-use garment 100 from the normal state to the activated state.

As illustrated in FIG. 1A, the emergency storage pocket 500 includes a pocket section 501 and a pocket access opening 503. A waterproof compartment 505 is provided on an inside of the pocket section 501. A signal tracking/transmitting device 507, such as a GPS tracker, a radio frequency identification (RFID) device, or beacon such as a radio beacon or other device that sends out a signal capable of being received, or the like, may be secured within the waterproof compartment 505. The remaining interior of the pocket section 501 may include various internal partitions or pockets 509 large enough to hold numerous items that could be used in emergency situations. This may include a section (s) large enough to hold a ration of food or water, tools, first aid items, and/or some type of flare or dye that disperses in water. One or all of the internal partitions or pockets 509 may include an insulating material lining the walls of a respective partition or pocket 509, which may substantially maintain foods or liquids at a given temperature. In other exemplary embodiments, heating elements may be provided in the walls defining the partitions or pockets 509, which can be activated by some type of manual manipulation or through an electrical device, in order to emit heat through the respective walls to areas within the pocket section 501. The pocket access opening 503 may include a flap that can open and close the pocket section 501, and/or include some type of device that allows for articles of clothing to be repeatedly fastened together and unfastened, such as the closable access 205*a* and opening/closing device 205*b* of the rapid inflation system 200.

The detachable pocket system(s) 600 according to an exemplary embodiment illustrated in FIG. 1A, includes a clip 610 to which a tether line or rope 620 ("tether 620") can be tied or otherwise attached. The tether 620 may include a clip at one end that can be clipped to the clip 610 on the body portion 120. The tether 620 is preferably made from an elastic material to be able to stretch, and is attached to a detachable pocket 630 that is received by a pocket attachment section 640 on the exterior of the daily-use garment 100.

The detachable pocket 630 is illustrated as being detached from the daily-use garment 100 in FIG. 1C, and further illustrated in detail in FIG. 3. An attaching section 633, which attaches to the pocket attachment section 640, is provided on the edges of the detachable pocket 630. The pocket 630 further includes a closable access 635*a* and an opening/closing device 635*b* that opens and closes the closable access 635*a*, similar to the closable access 205*a* and opening/closing device 205*b* of rapid inflation system 200. The tether 620 extends through a tether line opening 637 to attach to an interior of the detachable pocket 630. Similar to the emergency storage pocket 500, the detachable pocket 630 may include a waterproof compartment 639 that may contain a signal tracking/transmitting device similar to the signal tracking/transmitting device 507.

As illustrated in FIG. 1C, the detachable pocket 630 is detached from the pocket receiving section 641 and extends from the daily-use garment 100, but remains connected by the tether 620. The detachable pocket 630 may be attached to the daily-use garment 100 by attaching the attachment sections (633, 643*a*) with the attachment device 643*b*, which may be constituted by a zipper or similar fastening device. Alternatively, the attaching sections (633, 643*a*) may include strips of Velcro, snap connections, or similar fastening devices, to provide an attachment between the detachable pocket 630 and the pocket receiving section 641 without the attachment device 643*b*.

As noted above, the tether 620 may be elastic and able to stretch. This may be advantageous in certain situations where the detachable pocket 630 is detached from the daily-use garment 100 and caught on a branch or other objects when floating in water having a strong current, as might be the case in a flash flood. Due to the elasticity of the tether 620, a person wearing the daily-use garment 100 will have more time to try to cut the tether 620 (possibly with a cutting tool stored in the emergency storage pocket 500), before being pulled down by the detachable pocket 630 being caught on some object. In addition, a detaching mechanism can be provided within the detachable pocket 630 so that after a certain amount of tension is applied to the tether 620, the tether 620 will be released from the detachable pocket 630 and/or the daily-use garment 100.

In addition, during emergency situations, an immediate position of an individual may not allow for signal transmission by the signal tracking/transmitting devices in the emergency storage and/or detachable pockets (500, 630). The detachable pocket 630 and tether 620 can be used to position signal tracking/transmitting devices at a distance from the individual (who may not be able to move), to a location that is unobstructed by elements which may prevent the transmission and reception of signals from/to a signal tracking/transmitting device. The tether 620 may include a substantial amount of slack that is contained in the detachable pocket 630, so the detachable pocket 630 can be thrown by an individual a significant distance and later retrieved. In exemplary embodiments of the daily-use garment 100 including the detachable pocket 630, dye that disperses in liquid can be provided inside of the detachable pocket 630. The dye may disperse over a large area of liquid and color the surface of the area a bright color which may be spotted from a boat or airborne vehicle.

As noted above, the detachable pocket 630 may include a waterproof compartment 639 that may contain a signal tracking/transmitting device. Further, in exemplary embodiments of the daily-use garment 100, different types of signal tracking/transmitting devices can be provided inside of the waterproof compartments (505, 639). One signal tracking/transmitting device may include a GPS tracking device, such as the Garmin® Chirp™, that is programmable, and can transmit information such as coordinates of the daily-use garment 100. Other signal tracking/transmitting devices, such as an RFID or distress radio beacon, for example, may be provided. Exemplary embodiments of the daily-use garment 100 may also include sensors that detect when the daily-use garment 100 is converted to the activated state, and transmit signals to the one or more signal tracking/transmitting devices. In turn, the one or more signal tracking/transmitting devices may transmit a signal that indicates information from the sensor, to a network associated with the stored information data related to the purchaser/owner. Accordingly, the information data can be updated and/or authorities alerted to the daily-use garment 100 being converted to the activated state. The sensors may be located in or on any area of the daily-use garment 100.

Figure 4A:
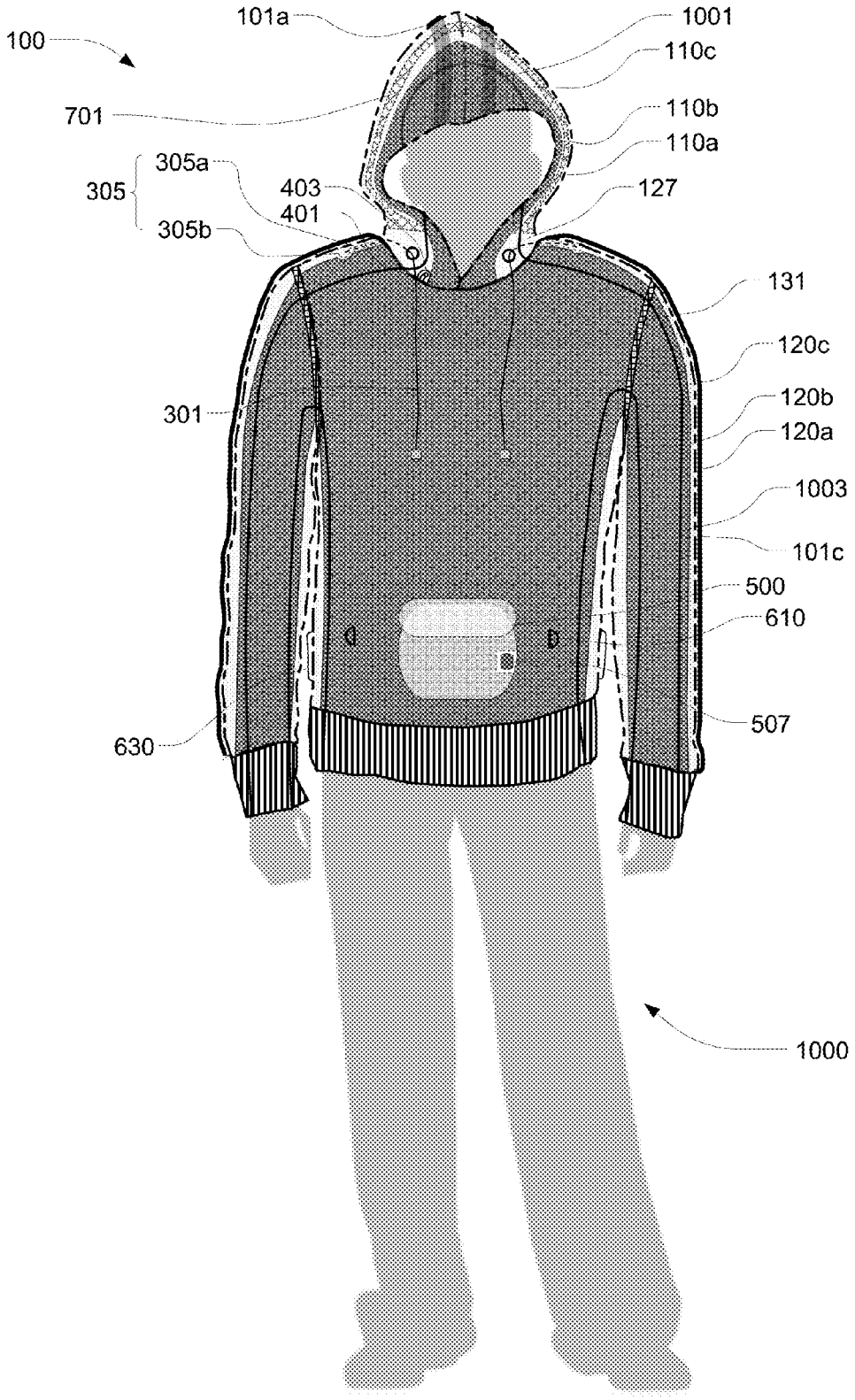
FIGS. 4A and 4B are partial views of a front of a daily-use garment according to an embodiment of the present disclosure.
Figure 4B:
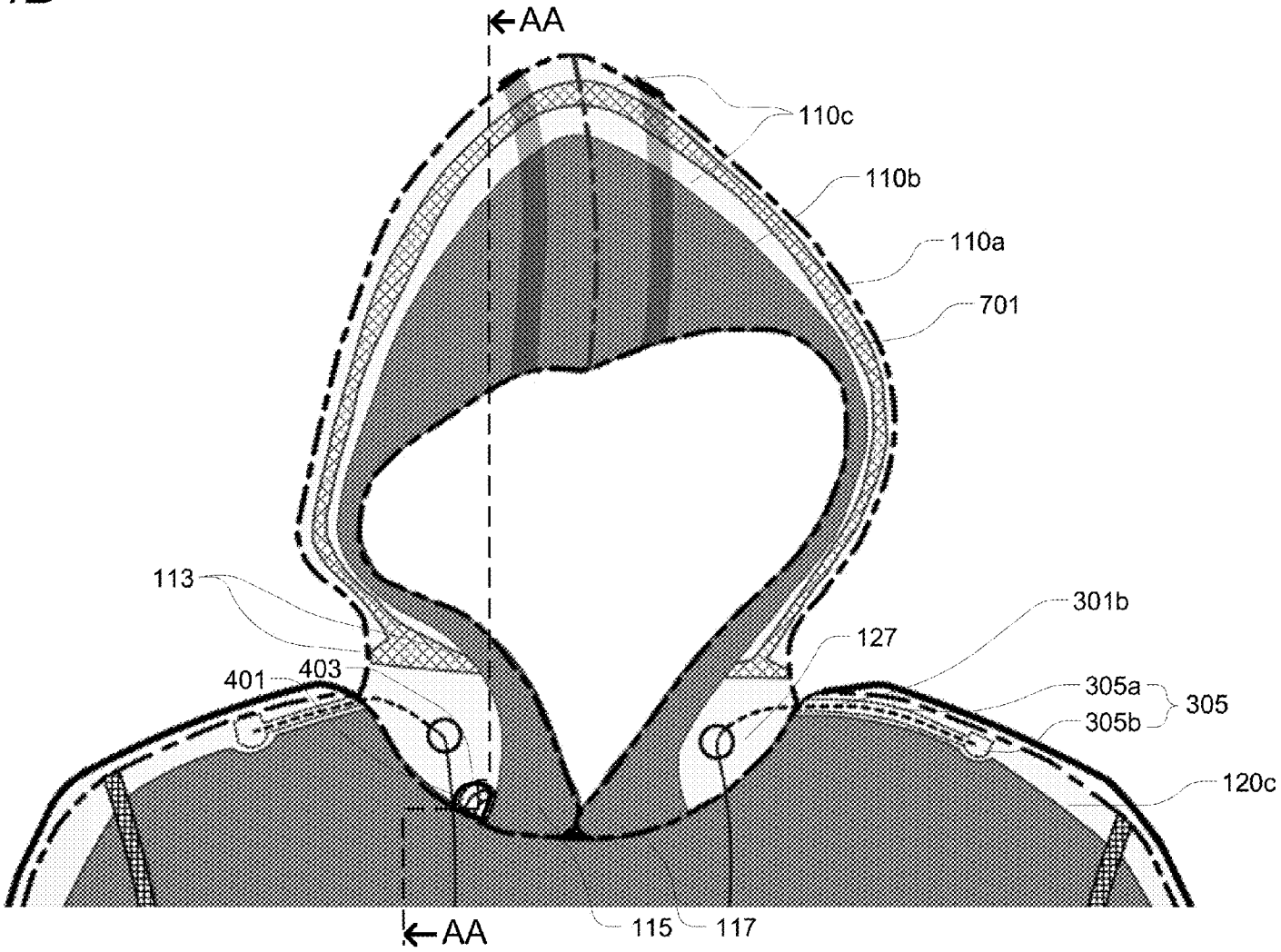

FIGS. 4A and 4B illustrate partial views of a front of an exemplary embodiment of the daily-use garment 100 according to the present disclosure. The daily-use garment 100 is illustrated as being worn on the body 1003 of a person 1000, with a head 1001 of the person 1000 covered by the head portion 110 but visible through the hood opening 111. As illustrated in FIG. 4A, the body portion 120 includes a body outer garment layer 120*a*, a body inner garment layer 120*b*, and a body inner space 120*c* there between. Similarly, the head portion 110 includes a head inner space 110*c* between a head outer garment layer 110*a* and a head inner garment layer 110*b*. The head inner garment layer 110*b* and the body inner garment layer 120*b* may be provided in one-piece, or separate pieces sewn together, or otherwise attached. When the head portion 110 is deployed as illustrated in FIGS. 4A and 4B, a first chamber 701 of an inflation system 700 surrounds a portion of the hood opening 111 and the head 1001 of the person 1000. The first chamber 701 is attached to the head outer garment layer 110*a* and head inner garment layer 110*b* by a head chamber attachment section 113.

As illustrated in more detail in FIG. 4B, the cord 301 extends through the cord opening into a neck passage 127 defined in the head portion between a neck inner garment layer 115 and the head outer garment layer 110*a*, and between the first chamber 701 and a neck line 117 of the daily-use garment 100. A first cord portion 301*b* of the cord 301 passes through the neck passage 127 into a first cord passage section 305*a* of the first manual activation system 300. The cord portion 301*b* is then strung along the shoulder section 123 towards the arm 125. As illustrated in FIGS. 5A-7, a second cord portion 301*c* extending from the first cord portion 301*b*, crosses the shoulder section 123 through a second cord passage 305*b* from the front side 121 and to the back side 122 of the daily-use garment 100. In addition to the cord 301, the inflation tube 401 of the second manual activation system 400 extends in the neck passage 127 in an inflation tube passage 405 also illustrated in FIGS. 5A-7.

Figure 5A:
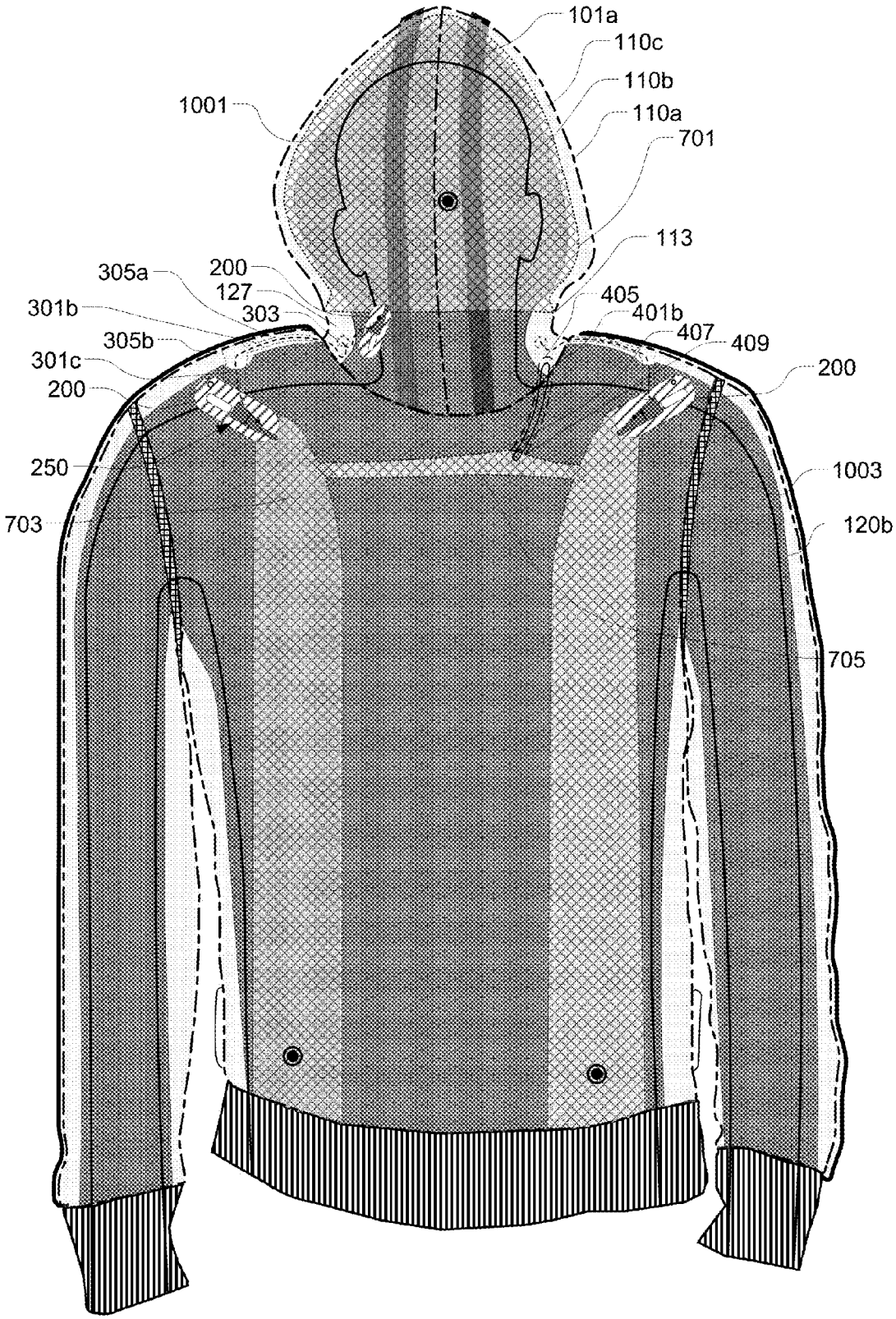
FIGS. 5A and 5B are partial views of a back of a daily-use garment according to an embodiment of the present disclosure.
Figure 5B:
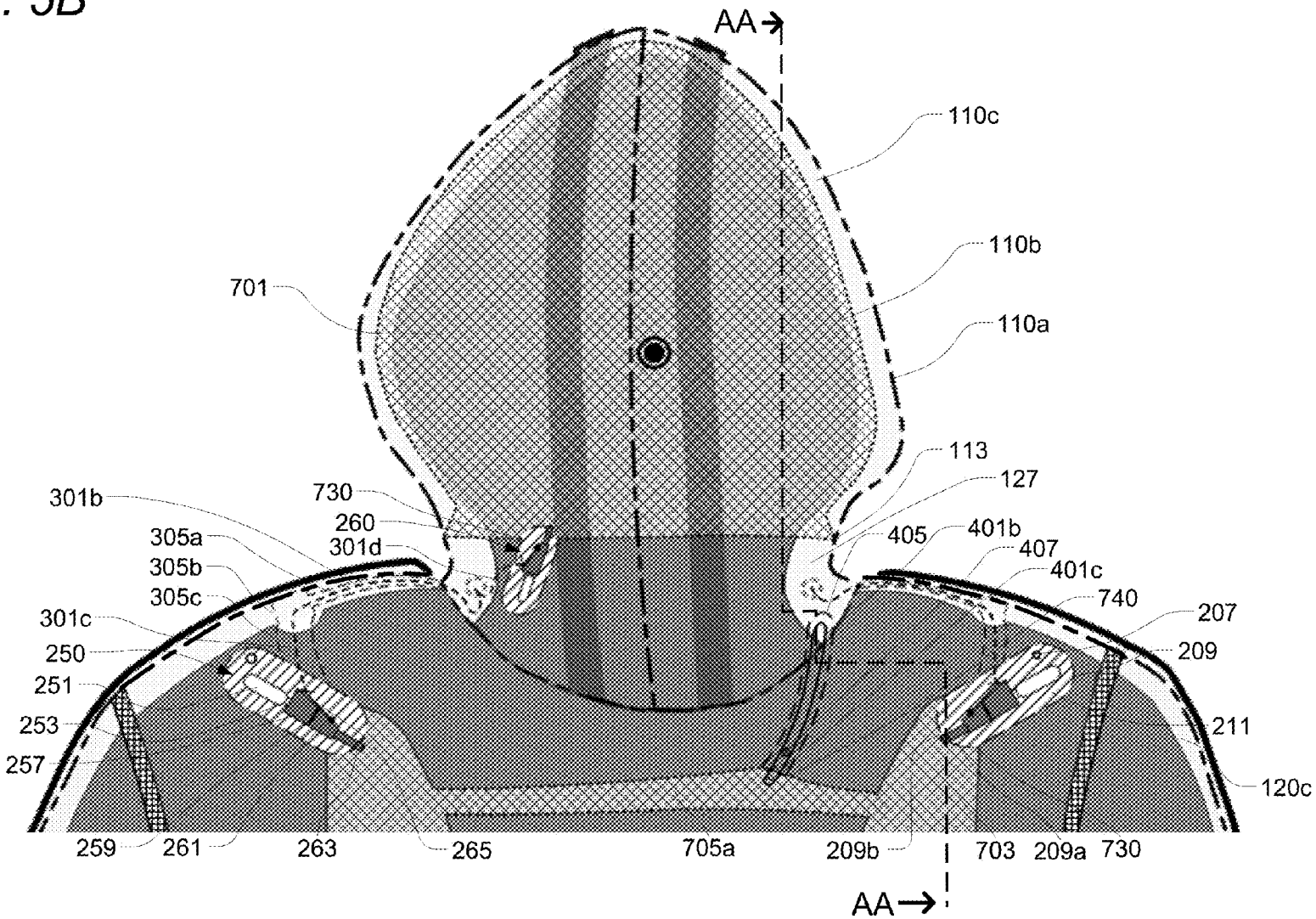

FIGS. 5A and 5B illustrate partial views of the back side 122 of the daily-use garment according to the present disclosure. As illustrated in FIG. 5A, the inflation system 700 includes the first chamber 701 extending within the head inner space 110*c* of the head portion 110, and second chambers 703 extending within the back side 122 of body portion 120. The second chambers 703 extend in the body inner space 120*c* from an upper area of the body portion 120 to a connection or seam between the elastic band 103 and the inner and outer body garment layers (120*a*, 120*b*). The bottom of each second chamber 703 can be attached to the seam between the body portion 120 and the elastic band 103. The second chamber 703 may also be connected and in fluid communication thereby, with a third chamber 705. Alternatively, the second chambers 703 may be completely separated from each other. The chambers (701, 703, and 705) may all be formed from the same material or different materials. It is preferable that a material used to form the chambers (701, 703, 705) is flexible (such as some forms of plastic) and pliable to adjust to the contours and or movements of a person wearing the daily-use garment 100. More importantly, the material used must be non-permeable and suitable for maintaining a volume of fluid under pressure.

As illustrated in more detail in FIG. 5B, each of the first chamber 701 and the second chambers 703 has an inflation system opening 730, which is attached to a respective rapid inflation system 200. An outlet wall section 209*a* of the compartment wall 209 of each rapid inflation system 200 covers the inflation system opening 730, and provides a portion of a wall defining each chamber (701, 703). A compartment outlet 209*b* is formed in the outlet wall section 209*a*. As previously noted, each rapid inflation system 200 includes an inlet/vent 207 which allows a fluid, such as a liquid, to flow into a compartment 211 defined by a respective compartment wall 209. An automatic rapid inflation device 250, or a manual rapid inflation device 260 provided for each rapid inflation system 200 is positioned in a respective compartment 211.

The automatic rapid inflation device 250 may be an Alpha Inflator® or PRO F1® by Halkey-Roberts®; a Secumatic 3001S, Secumatic 4001S, or Secumatic 401S by Secumar®; or an A1 Inflator by Hammar®. The manual rapid inflation device 260 may be a PRO F3® by Halkey-Roberts®; a Secumar 301SM or Secumatic 4001S with a Manual Override 4001S by Secumar®; or an M1 Inflator by Hammar®. The list of inflation devices provided herein is not exhaustive. Exemplary embodiment of the present disclosure may incorporate other types of automatic or manually operated inflation devices.

Exemplary embodiments of the rapid fluid inflation devices (250, 260) may include a detachable fluid container 251 attached to one end of a valve body 257 by a fluid supply attachment 253, and a discharge tube 263 attached to an opposite end of the valve body 257. As illustrated in FIG. 5B, each of the rapid fluid inflation devices (250, 260) is arranged so that a respective discharge tube 263 is positioned relative to a respective compartment outlet 209*b* (e.g. extending through or flush with the compartment outlet 209*b* to be in fluid communication with a respective chamber). The detachable fluid container 251 (such as a $CO_2$ cylinder, for example) contains a pressurized fluid (e.g. $CO_2$, $O_2$, or other gas or liquid that can remain pressurized in a closed container) that may be supplied through the valve body 257 and out the discharge tube 263, when the detachable fluid container 251 is opened by the operation of a respective rapid inflation device (250, 260). If fluid is no longer in the detachable fluid container 251, the closeable access 205*a* of a respective rapid fluid inflation system may be opened with the opening/closing device 205*b*, and the detachable fluid container 251 may be replaced. Other types of fluid may be provided in the detachable fluid container 251, such as liquid expanding foam for embodiments of a daily-use garment according to the present disclosure intended for a single activation.

The automatic rapid inflation device 250 includes an actuator 259 that can automatically cause the opening mechanism to open the detachable fluid container 251 when the automatic rapid inflation device 250 comes in contact with a liquid. In particular, the actuator 259 may include a dissolvable member, such as a pill or bobbin, that dissolves in liquid over a period of time, and causes the detachable fluid container 251 to open. In exemplary embodiments where a dissolvable member is used as the fluid sensitive actuator 259, the size of the dissolvable member may be selected based on a time required to fully dissolve the dissolvable member. Thus, a built-in time delay may be provided so that the fluid sensitive actuator 259 causes the automatic rapid inflation device 250 to operate only after a required period of time that the automatic rapid inflation device 250 has been submerged in a liquid has elapsed.

In other exemplary embodiments, the actuator 259 may be sensitive to pressure and contact with a liquid, to automatically operate the automatic rapid inflation device 250 when a person wearing the daily-use garment 100 falls into a body of liquid such as water. For example, when an individual is thrown from a boat, the actuator 259 may actuate the automatic rapid inflation device 250 upon a forcible impact with a surface of the body of liquid.

As previously described, the actuator 259 may cause an operation of the automatic rapid inflation device 250 after a particular type of contact (e.g. based on duration, volume, pressure) with a liquid. This ensures the daily-use garment 100 is not automatically converted prematurely, or in conditions that would not require a conversion to the activated state. Therefore, the automatic rapid inflation devices 250 are prevented from being operated when only minimal contact with a liquid has occurred. Thus, the daily-use garment 100 may not be converted from the normal state in situations where there may be some precipitation, and portions of the daily-use garment 100 including the rapid inflation systems 200 get wet, but only to a certain degree.

The automatic rapid inflation device 250 and the manual rapid inflation device 260 can be manually operated to open the detachable fluid container 251. In particular, when a manual actuator lever 265 is pulled to move about a pivot 261 towards the discharge tube 263, a hole may be caused to be formed in the detachable fluid container 251. As a result, pressurized fluid escapes from the detachable fluid container 251.

As illustrated in FIGS. 5B-6B, the second portion 301*c* of the cord 301 of the first manual activation system 300 is connected to a hole 265*a* in the manual actuator lever 265. As a result, a movement of the cord 301 may move the manual actuator lever 265 in a direction which causes the detachable fluid container 251 to be opened, thus converting the daily-use garment 100 from the normal state to the activated state. The second cord portion 301*c* runs through a third cord passage section 305*c* into the compartment 211 of the rapid inflation system 200. The third cord passage section 305*c* is connected to the second cord passage section 305*b*, which extends from the shoulders 123 down the back side 122 in the body inner space 120*c*.

As illustrated in FIG. 5B, a fourth cord portion 301*d* is provided in the neck space 127, and is attached to the manual actuator lever 265 of the manual rapid inflation device 260, which is located in the rapid inflation system 200 in the head portion 110. Thus, only the cord 301 passing out of cord opening 303 on the right side of the head portion 110 if one is facing the front side 121 of the daily-use garment 100, may include the fourth cord portion 301*d*. It should be noted that instead of the fourth cord portion 301*d*, another cord can be provided which is run through the cord opening 303 into the neck space 127 separate from the cord 301, and attached to the manual rapid inflation device 260. Thus, the manual rapid inflation device 260 may be operated independently of the manual or automatic rapid inflation devices in other rapid inflation systems 200.

In the inflation system 700, the second chambers 703 are connected by a third chamber 705. This provides several advantages, the first being that should one rapid inflation system 200 not be able to automatically inflate the second chamber 703, manual activation of only that or another rapid inflation device may be sufficient to supply pressurized fluid to both of the second chambers 703. This gives an individual the option to only activate the one of the rapid inflation systems that is activated by a drawstring cord 301 that is not connected to the rapid inflation system 200 for the head portion 110, while still inflating both second chambers 703.

The arrangement of the first manual activation system 300 permits any person wearing the daily-use garment 100 (or next to a person wearing the daily-use garment 100) to convert the daily-use garment 100 from the normal state to the activated state at any time desired. Thus, if actuators 259 in any or all of the automatic rapid inflation devices malfunction or are incapable of causing an operation of respective automatic rapid inflation devices, a person may pull the pull-tabs 301*a* to convert the daily-use garment 100 from the normal state to the activated state.

The second manual activation system 400 is illustrated in detail in FIG. 5B. The inflation tube 401 of the second manual activation system 400 extends in the neck space 127 in the inflation tube passage 405. In particular, a main tube section 401*b* extends in the inflation tube passage 405 from a first tube end 401*a* at the tube opening 403, to a second end 401*c* positioned in the inner body space 120*c* on the back side 122 of the daily-use garment 100. The inflation tube 401 may extend through an inflation tube opening 740 in a wall of the third chamber 705, which may be attached to an end of the inflation tube passage 405. An individual may blow into the tube 401, or find an external source of pressurized fluid to connect to the tube 401, and supply fluid to the third chamber 705. As a result, fluid will flow from the third chamber 705 into the second chambers 703.

In the event that the rapid inflation systems 200 in the body portion 120 and the head portion 110 malfunction (or are not provided or do not have a container with pressurized fluid), and do not inflate the first chamber 701 or the second chamber 703, an individual may blow into the inflation tube 401. The inflation tube 401 includes an in-line one-way valve 407. Thus, a supply of air from the inflation tube 401 cannot escape because of the in-line one-way valve 407, and may fill the second chamber 703 and therefore convert the daily-use garment 100 from the normal state to the activated state. It will be understood that an inlet tube could also be provided extending from the front side 121 of the daily-use garment 100 through the neck space 127, and attached to the first chamber 701 to be able to inflate the first chamber 701 using the second manual activation system 400. This second inflation tube may consist of a branch from the inflation tube 401, which may include a respective inline one-way valve. Alternatively, the additional tube may be provided in the neck space 127 on an opposite side of the head portion 110 as the inflation tube 401, with a respective inflation tube opening on the exterior of the daily-use garment 100.

Figure 6A:
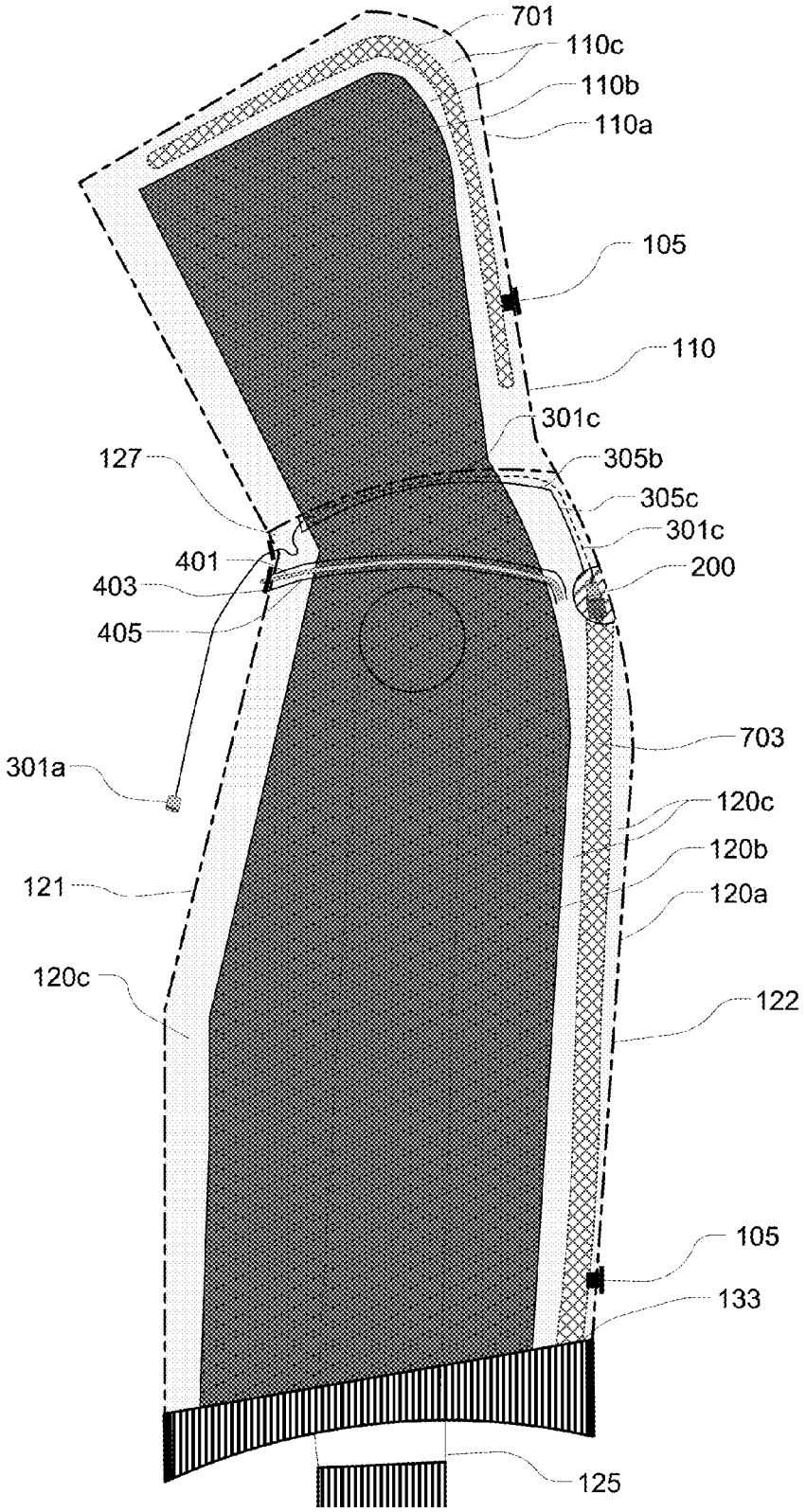
FIGS. 6A and 6B are sectional views along line AA-AA, as shown in FIGS. 4B and 5B, of a daily-use garment according to an embodiment of the present disclosure.
Figure 6B:
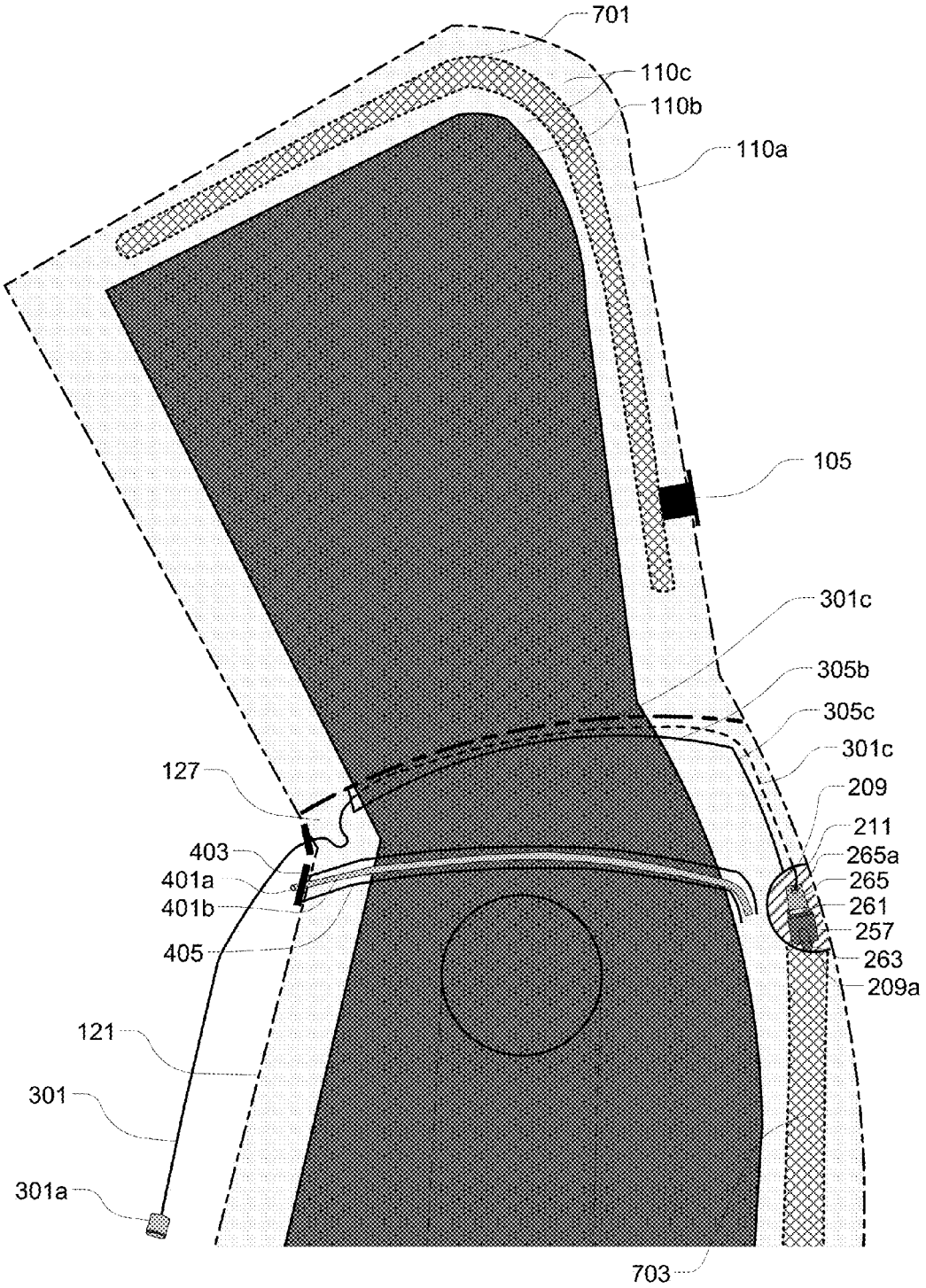

FIGS. 6A and 6B illustrate a sectional view of a daily-use garment 100 along line AA-AA in FIGS. 4B and 5B. As provided in FIG. 6A, the first chamber 701 is positioned in the head inner space 110*c*, and the relief valve 105 extends from the first chamber 701. The second chamber 701 is positioned in the body inner space 120*c*, and the relief valve 105 extends from the second chamber 701. Further, as illustrated in detail in FIG. 6B, the cord 301 including the pull-tabs 301*a*, extends through the second cord passage section 305*b* across the shoulder section 123 with the second cord portion 301*c*. The second cord portion 301*c* runs through the third cord passage section 305*c* to attach to the hole 265*a* in the manual actuator lever 265 in the compartment 211 of the rapid inflation system 200. The rapid inflation system 200 includes the compartment wall section 209*a* that is surrounded by the inflation system opening 730 of the second chamber 703. In addition, the inflation tube passage 405 extends from the front side 121 to the back side 122, and the main tube section 401*b* extends from the first tube end 401*a* to the second tube end 401*c* in the inflation tube passage 405.

Figure 7:
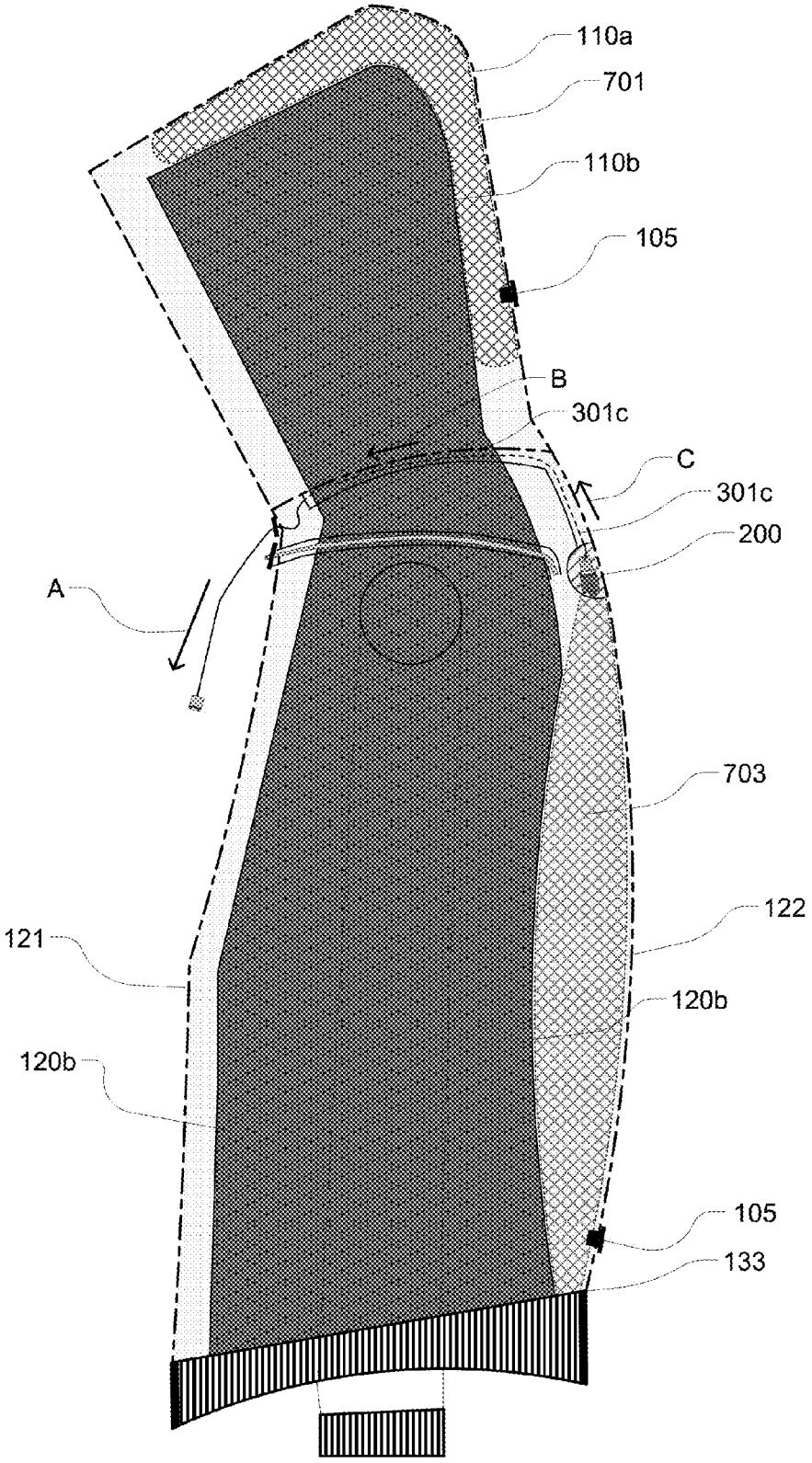
FIG. 7 is a sectional side view of an embodiment of a daily-use garment in an activated state.

An exemplary embodiment of the daily-use garment 100 according to the present disclosure in an exemplary activated state, is illustrated in FIG. 7. However, the activated state may include at least one, although not necessarily all, of the chambers (701, 703) being filled with fluid. As a result, the daily-use garment 100 can be used as a personal flotation device in the activated state to maintain a person wearing the daily-use garment 100 above the surface of liquid the person may be in.

As discussed above, the daily-use garment 100 may be converted from the normal state to the activated state in multiple ways. With respect to the rapid inflation systems 200, when the actuator 259 operates a respective rapid inflation device 250 for one of the second chambers 703, fluid is supplied to both second chambers 703. As illustrated in FIG. 7, the second chamber(s) 703 in an expanded state, press against an interior side of the body outer garment layer 120*a*, and an exterior side of the body inner garment layer 120*b*. This would also be the case where one of the cords 301 is pulled in a direction A, causing the second cord portion 301*c* to move in a direction B in the second cord passage section 305*b*, and upward in a direction C in the third cord passage section 305*c*. Although the second chambers 703 are connected via the third chamber 705 so that only one rapid inflation system 200 is need to inflate both chambers, exemplary embodiments of the daily-use garment 100 may provide second chambers 703 that are separated with dedicated rapid inflation systems 200 which only inflate respective second chambers 703. In addition, if fluid is supplied through the inflation tube 401, the second chamber 703 is supplied with pressurized fluid and expands in the inner body space 110*c*.

The activated state may include, or be limited to, the first chamber 701 being inflated in the head portion 110. With respect to the first chamber 701, this chamber will expand in the inner head space 110*c* if the rapid inflation device 260 is manually operated. In the alternative, a second inflation tube connected to the first chamber 701 may be provided. In some exemplary embodiments of the daily-use garment 100, a portion of the inner head garment layer 110*b* may be formed from a material that is less pliable than other materials which form the other garment layers of the daily-use garment 100. The inner head garment layer 110*b* could thereby provide a type of shell with a degree of rigidity, sufficient to absorb some pressure applied to a head of an individual when the first chamber 701 is inflated.

The daily-use garment 100 includes first, second, and third chambers (701, 703, 705). In addition, additional chambers may be provided in portions of the arms 125 corresponding to wrists of a person wearing the daily-use garment 100. When inflated, either by connection to the other chambers, or through respective inflation tubes provided therewith, the daily-use garment 100 will substantially support an individual's arms above a body of liquid such as water. In addition, these chambers may be arranged to tightly fit around a person's wrists when inflated, and prevent liquid from entering into portions of the daily-use garment 100.

Figure 8A:
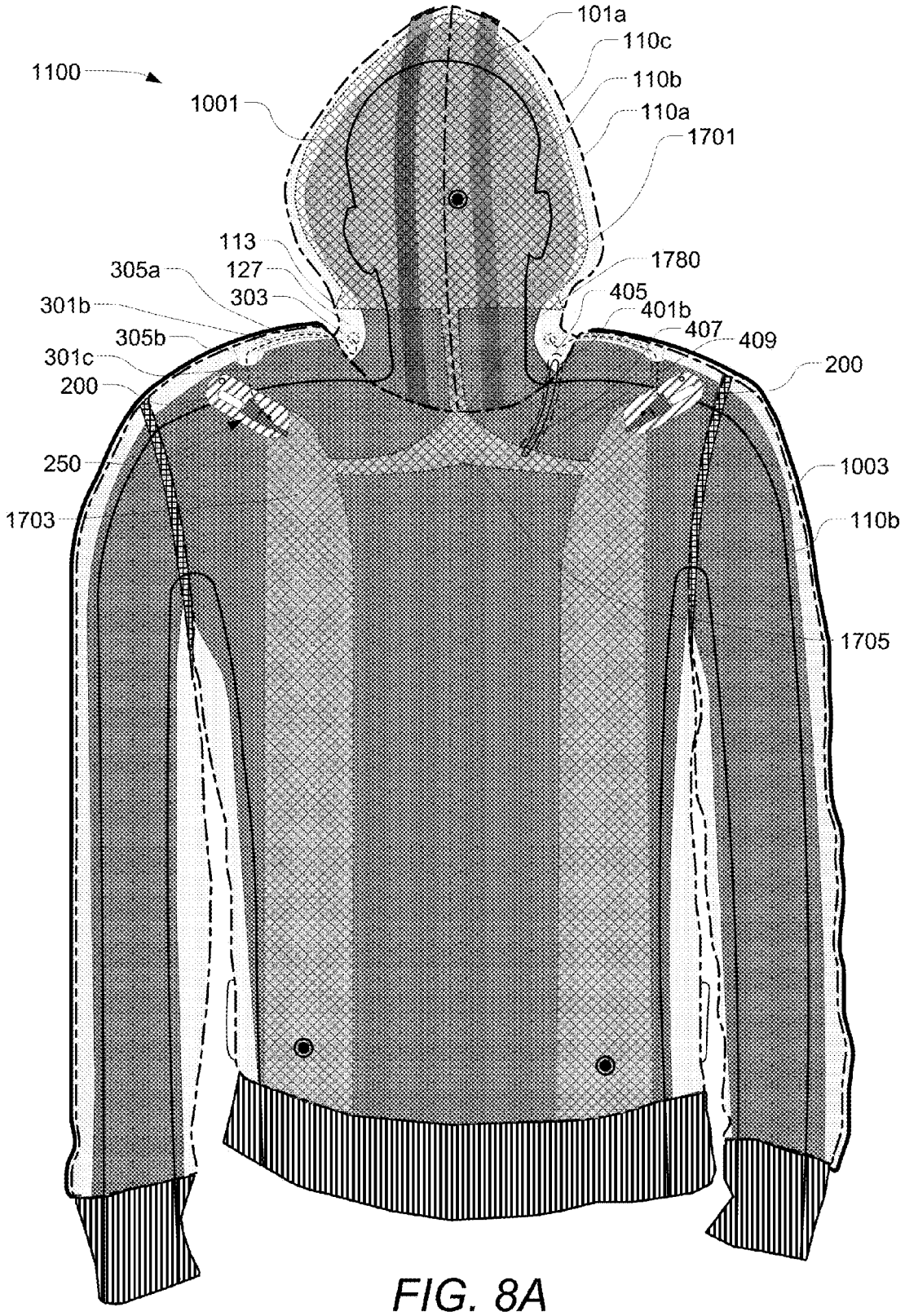
FIGS. 8A and 8B are partial views of a back of a daily-use garment according to an embodiment of the present disclosure.
Figure 8B:
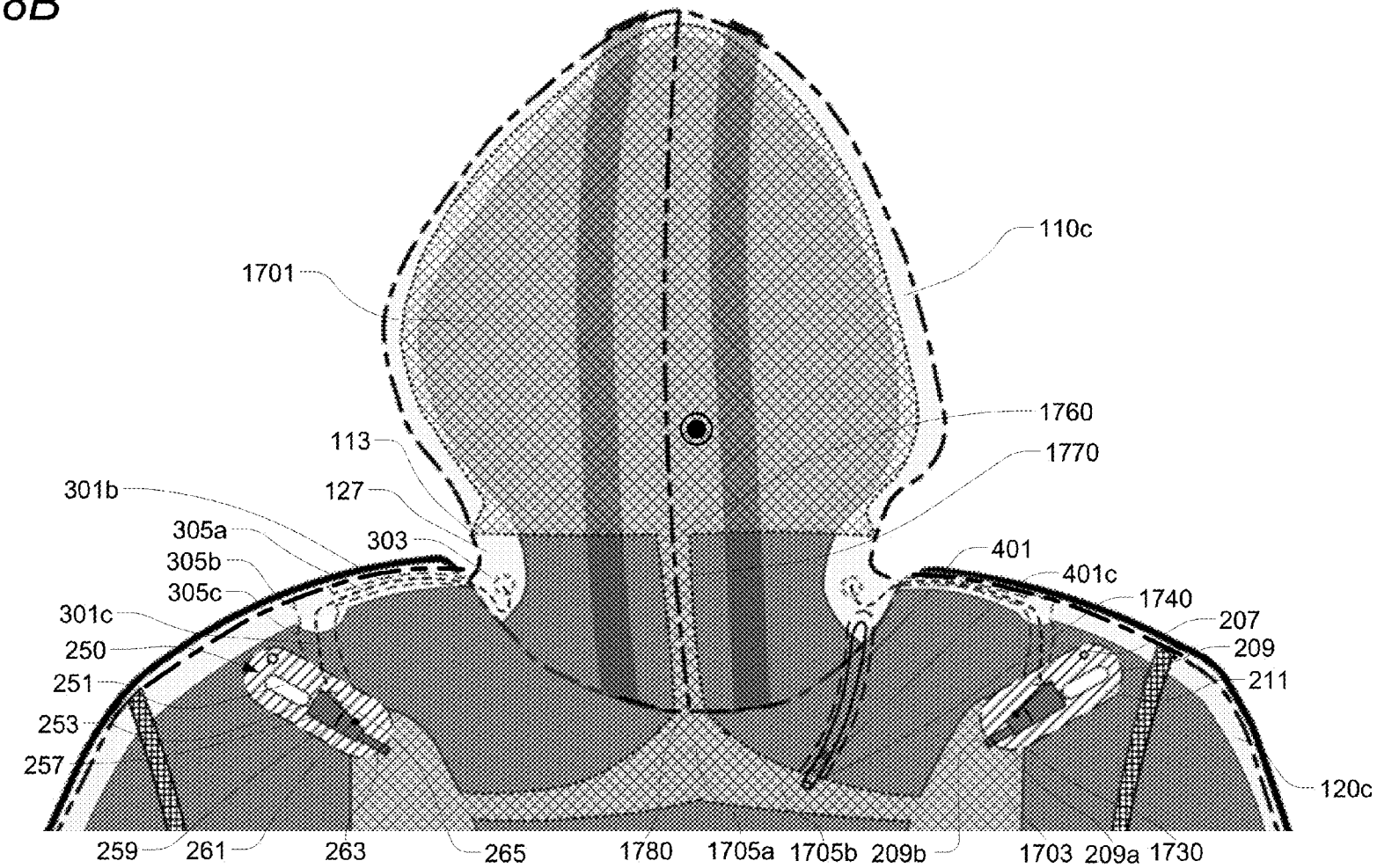

FIGS. 8A and 8B illustrate partial views of a back of a daily-use garment 1100 including a second inflation system 1700. The second inflation system includes a first chamber 1701, a second chamber 1703, and a third chamber 1705. The second inflation system 1700 includes an inflation tube opening 1740 that connects to an inflation tube passage 405, and through which a second tube outlet 401*c* of an inflation tube 401 of the daily-use garment 1100 extends. Each rapid inflation system 200 of the daily-use garment 1100, is attached to respective second chambers 1703 with respective inflation system openings 1730. In addition, a first chamber inlet opening 1760 connects to a connecting chamber passage 1770, which is connected to a third chamber connection 1780. The third chamber connection 1780 is in communication with a central chamber 1705*a* of the third chamber 1705, which is connected to the second chambers 1703 by branch chambers 1705*b*.

A difference between the first inflation system 700 and the second inflation system 1700, is that the first chamber 1701 is connected to the third chamber 1705. When the rapid inflation devices 250 are operated, the daily-use garment 1100 converts from the normal state to the activated state with pressurized fluid flowing from the rapid inflation systems 200 into the second chambers 1703, and simultaneously through the third chamber 1705 into the first chamber 1701. This reduces the need for an additional rapid inflation system 200 specifically for a head portion 110 of the daily-use garment 1100. Likewise, fluid supplied with a second manual activation system 400 of the daily-use garment 1100 will also inflate the first chamber 1701 and both of the second chambers 1703.

Figure 9A:
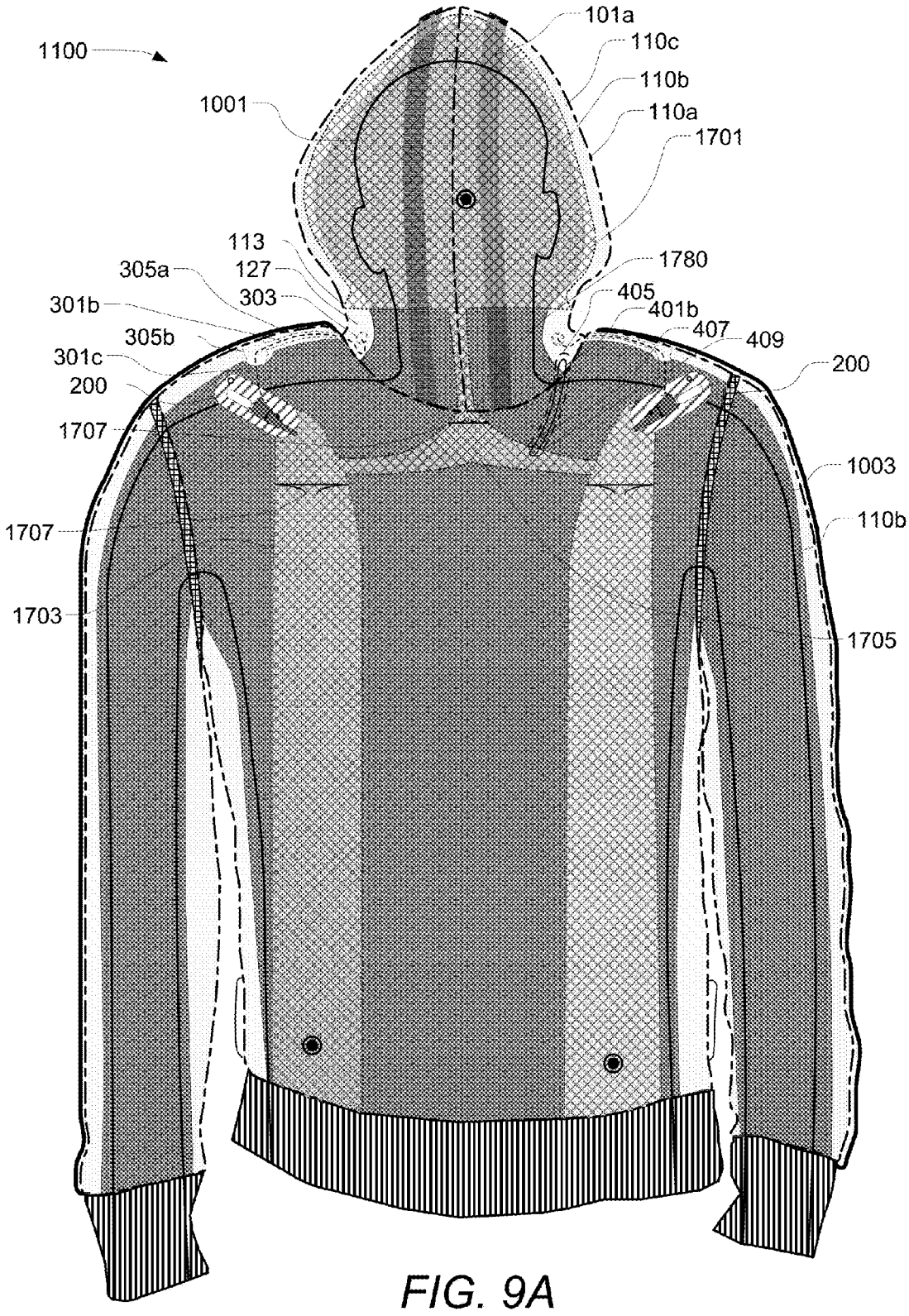
FIGS. 9A and 9B are partial views of a back of a daily-use garment according to an embodiment of the present disclosure.
Figure 9B:
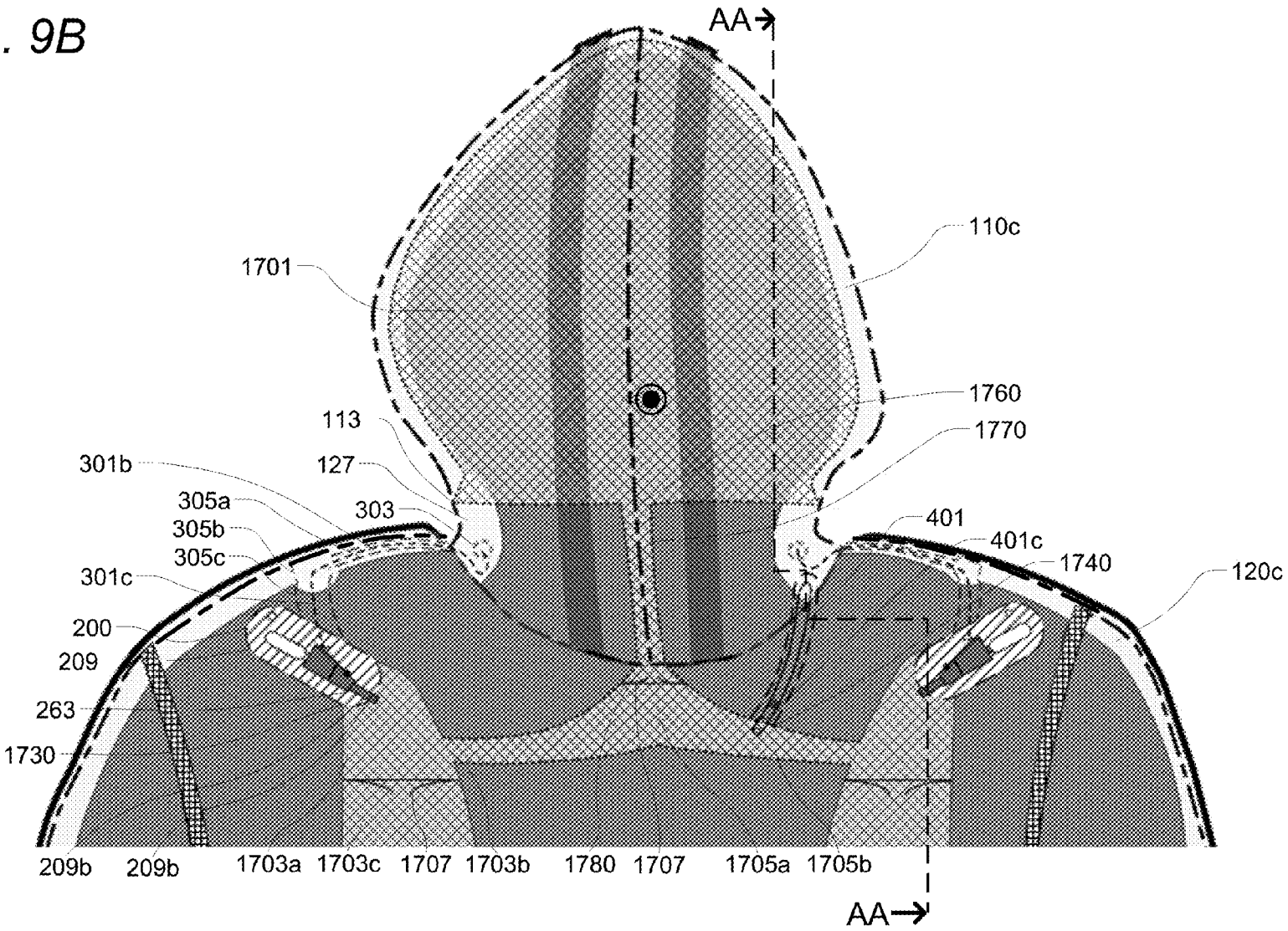

FIGS. 9A and 9B show partial views of a back of the daily-use garment 1100 including a modified second inflation system 1700. In the modified second inflation system 1700, one-way valves 1707 are provided in each of the second chambers 1703, and the third chamber 1705. When pressurized fluid is supplied via at least one rapid inflation system 200, fluid will flow into an inlet chamber 1703*a*. From there, the fluid will move through the one-way valves 1707 into a main chamber 1703*c* of the first chamber 1703, and through a chamber outlet 1703*b* into the third chamber 1705. The fluid may then flow through the one-way valve 1707 above the central chamber 1705*a* and into the first chamber 1701. The pressurized fluid may also pass through the third chamber 1705, and through the chamber outlet 1703*a* of the other second chamber 1703 into a respective main chamber 1703*c*. Accordingly, as with the second inflation system 1700, either of the rapid inflation systems 200 may be used to automatically or manually inflate all of the chambers (1701, 1703) in the daily-use garment 1100 with the modified second inflation system 1700.

Figure 10A:
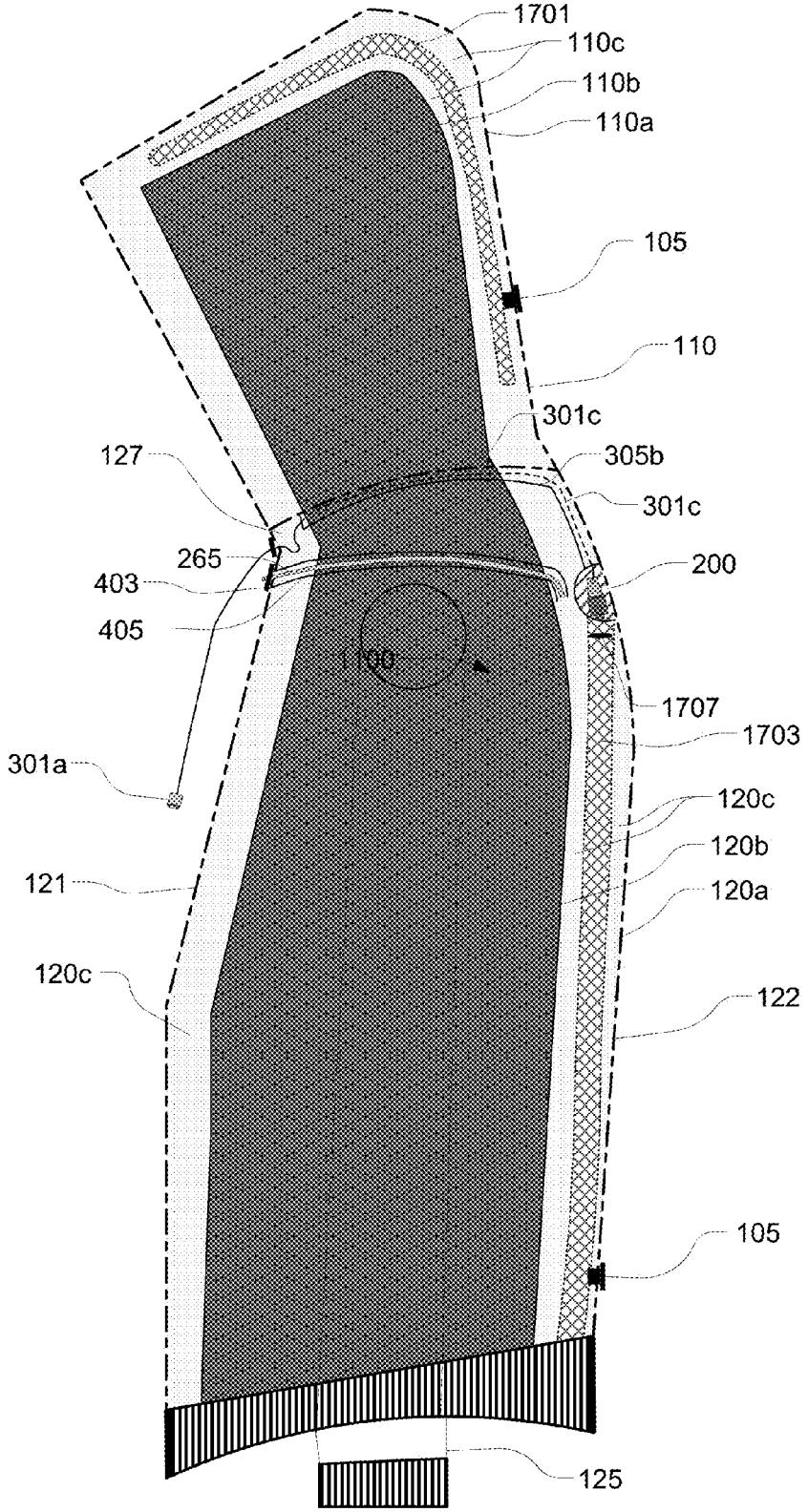
FIGS. 10A and 10B are sectional views along line AA-AA, as shown in FIG. 9B, of a daily-use garment according to an embodiment of the present disclosure.
Figure 10B:
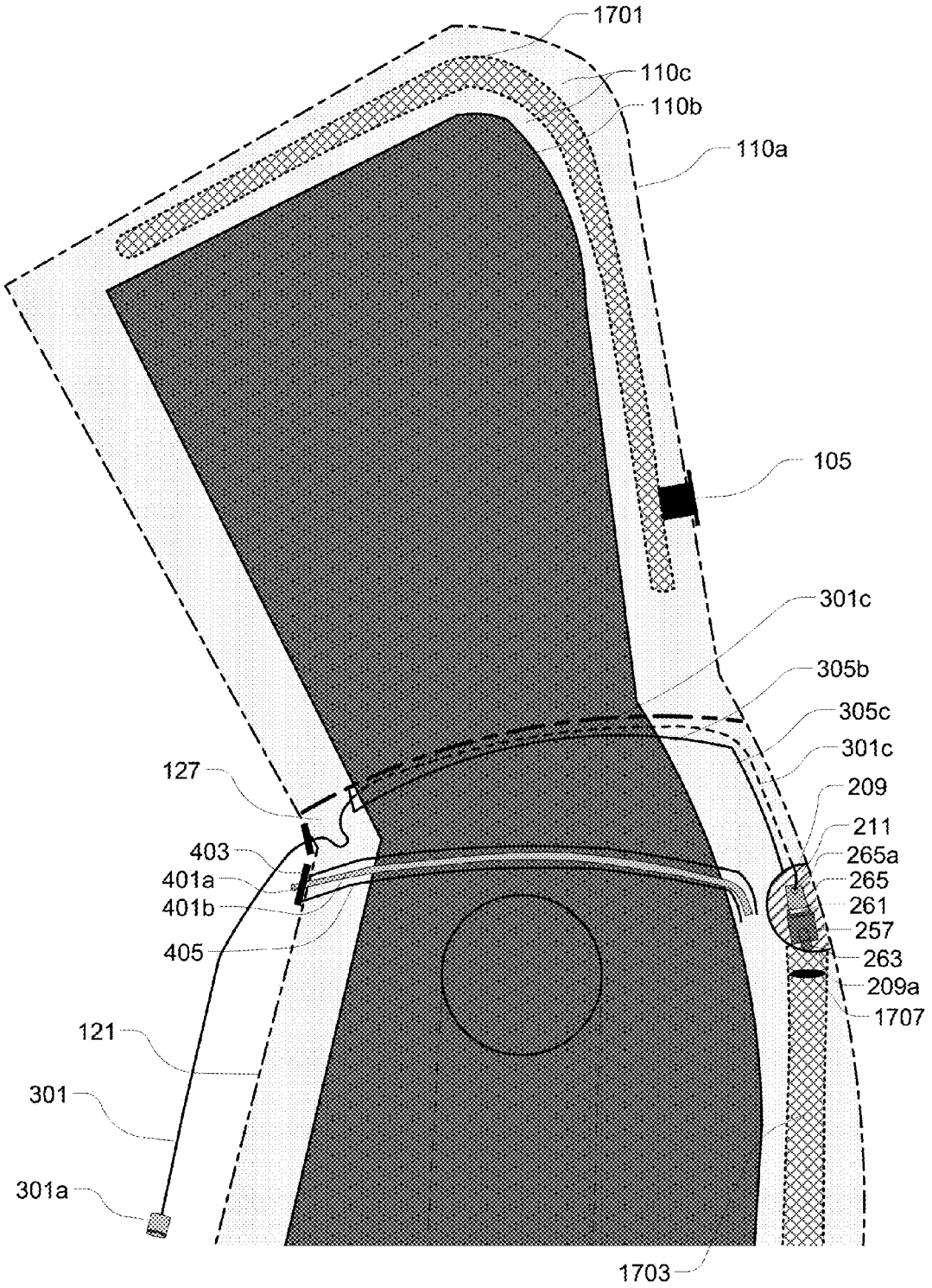

Providing one-way valves 1707 as illustrated in FIGS. 10A and 10B, may be advantageous in situations where one of the chambers (1701, 1703, 1705) has a hole or slow leak. Fluid in unaffected chambers will not escape because respective one-way valves 1707 will maintain the pressure in those chambers. As illustrated in FIGS. 10A and 10B, the one-way valve 1707 does not take up much room within the second chamber 1703. It will be understood that the one-way valves 1707 could be provided by flapper-valves or other types of one-way valves that are capable of moving with a flexible structure such as the chambers (1701, 1703, 1705). As with the first inflation system 700, the chambers 1701, 1703, and 1705 may be formed from a flexible material, such as plastic, that will not permit air to pass through respective chamber walls.

Figure 11A:
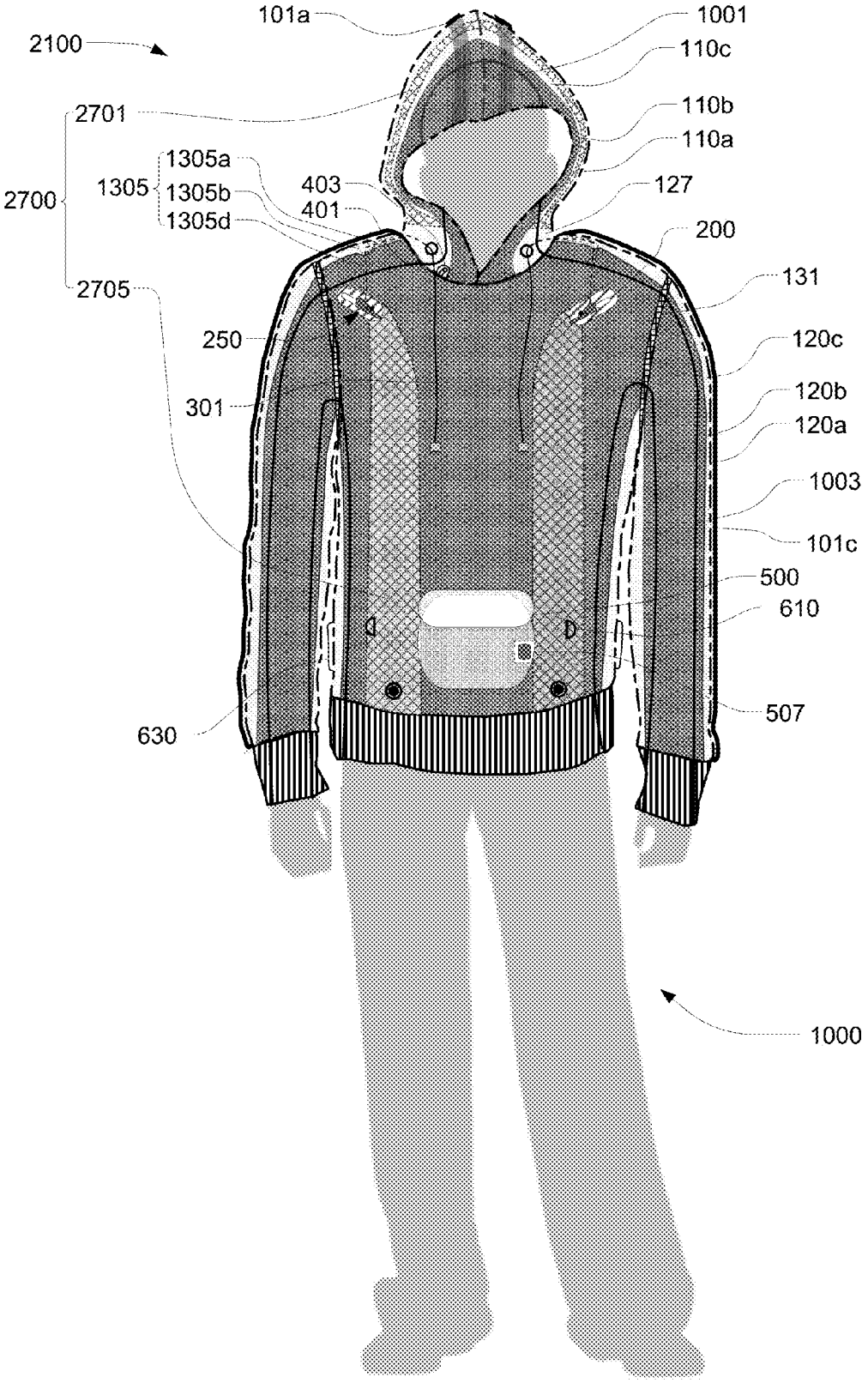
FIGS. 11A and 11B are partial views of a front of a daily-use garment according to an embodiment of the present disclosure.

FIGS. 11A to 14 illustrate a daily-use garment 2100 according to the present disclosure. In particular, FIGS. 11A and 11B illustrate a partial view of the front of the daily-use garment 2100. A feature of the daily-use garment 2100 is a third inflation system 2700 which includes a first chamber 2101 in a head portion 110, a large second chamber 2703 in an inner space 120*c* in a back side 122, and third chambers 2705 in an inner space 120*c* in a front side 121 of the daily-use garment 2100. The third inflation system 2700 includes an inflation tube opening 2740 that connects to an inflation tube passage 405, and through which a second tube outlet 401*c* extends into the large second chamber 2703. Rapid inflation systems 200 for the daily-use garment 2100 are attached to the large second chamber 2703 and the third chambers 2705 with respective inflation system openings 2730. Similar to the second inflation system 1700, a first chamber inlet opening 2760 connects to a connecting chamber passage 2770, which is connected to the second chamber 2703 by a chamber connection 2780.

Figure 12A:
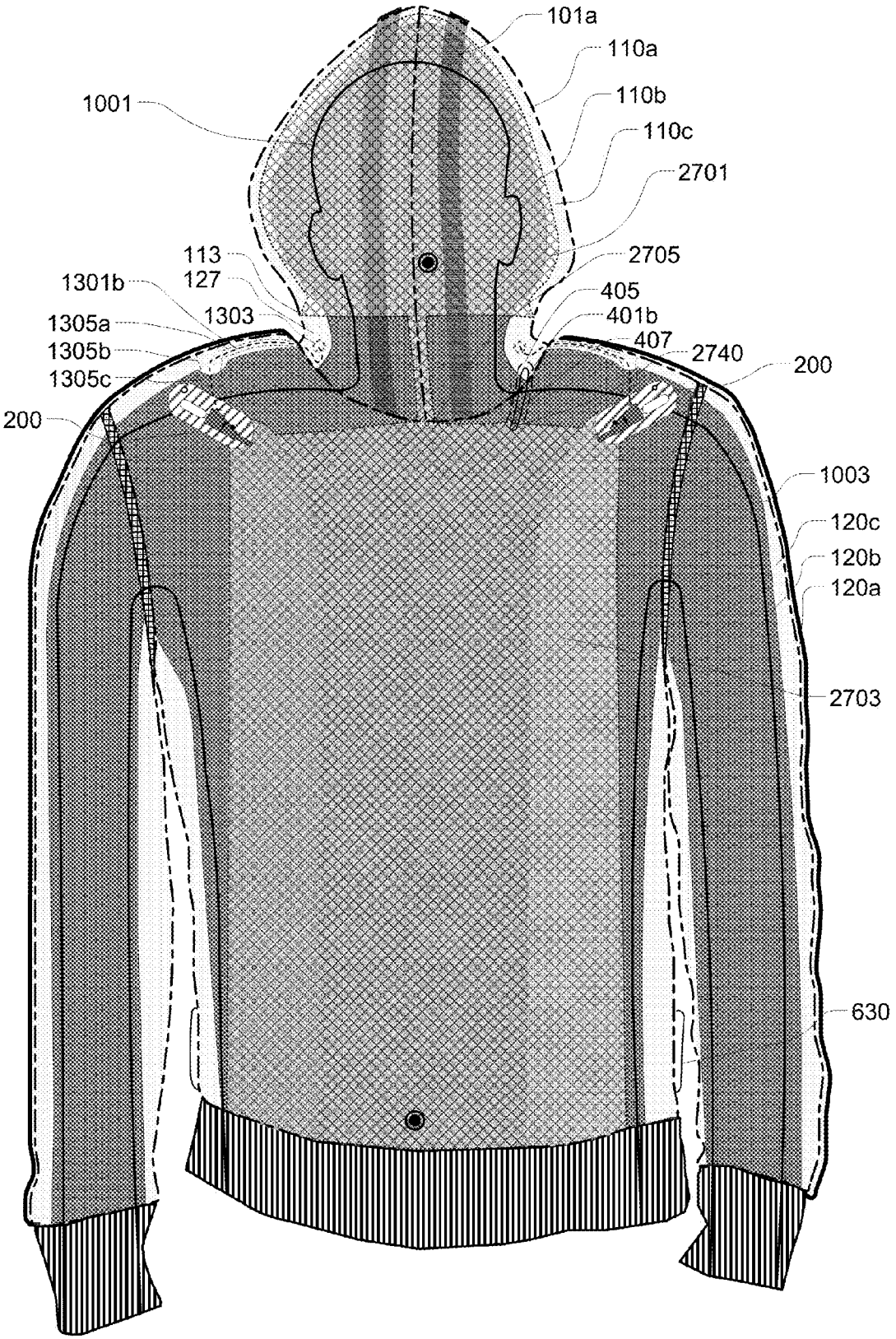
FIGS. 12A and 12B are partial views of a back of a daily-use garment according to an embodiment of the present disclosure.
Figure 12B:
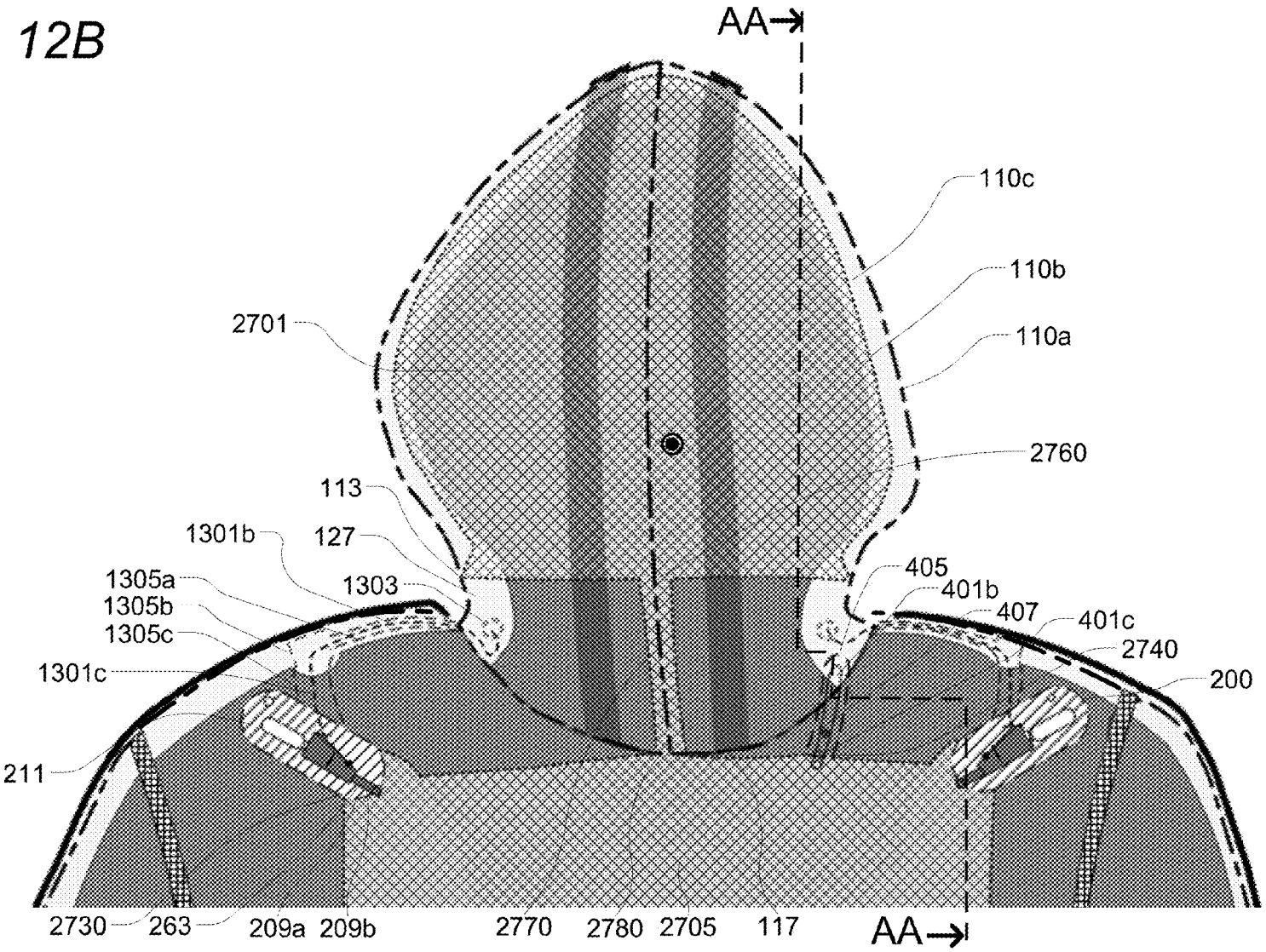

The daily-use garment 2100 also includes a first manual activation system 1300 that includes additional features with respect to the first manual activation system 300. Similar to the first manual activation system 300, the first manual activation system 1300 of the daily-use garment 2100 includes a cord 1301 and a cord passage 1305. The cord 1301 includes pull-tabs 1301*a*, and a first cord portion 1301*b* extends through a first cord passage section 1305*a*. A second cord portion 1301*c* is run through a second cord passage section 1305*b* across a shoulder section 123 of the daily-use garment 2100, and through a third cord passage section 1305*c* extending downward to be attached to the rapid inflation system 200 as illustrated in FIGS. 12A and 12B.

Figure 11B:
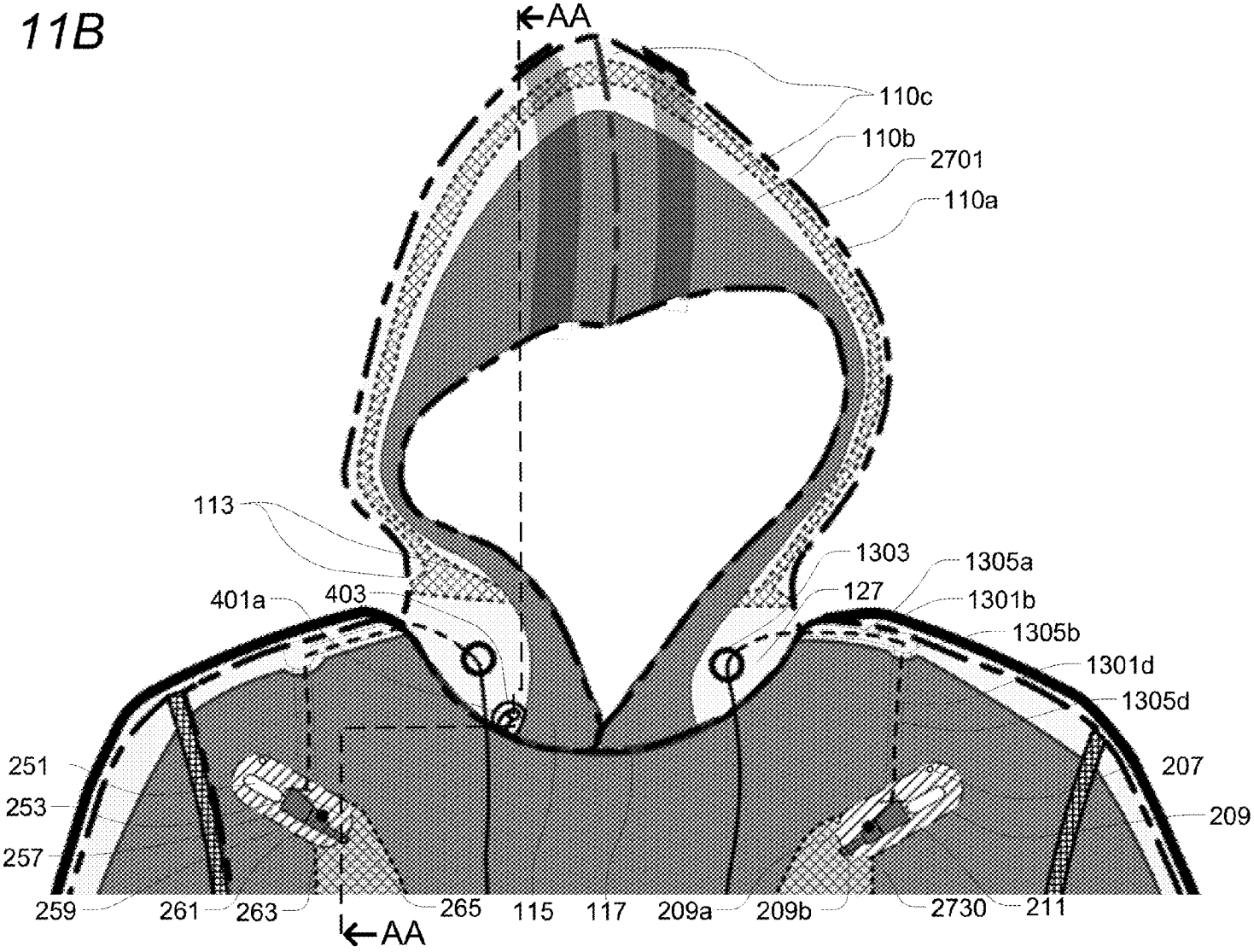
Figure 13A:
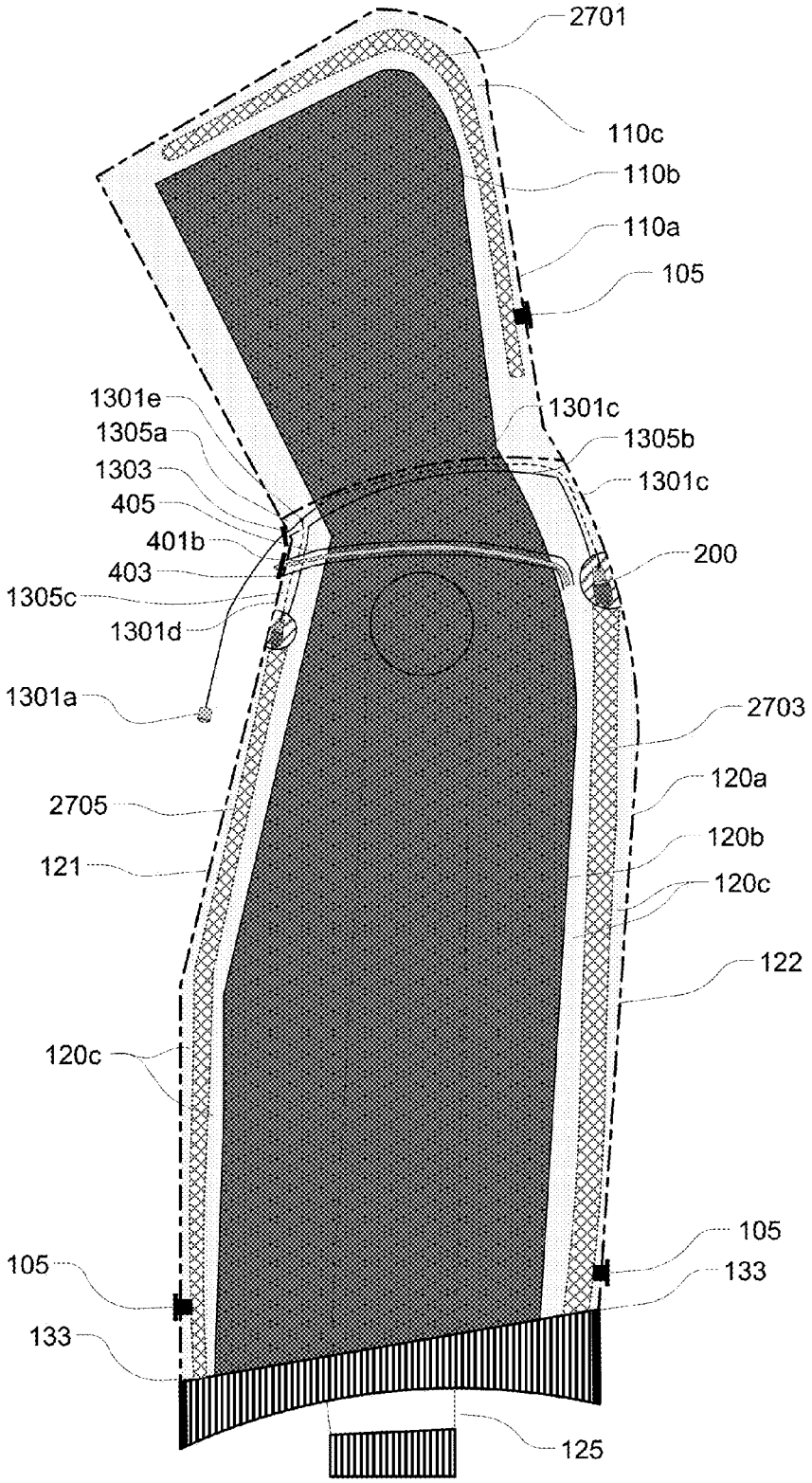
FIGS. 13A and 13B are sectional views along line AA-AA, as shown in FIGS. 11B and 12B, of a daily-use garment according to an embodiment of the present disclosure.
Figure 13B:
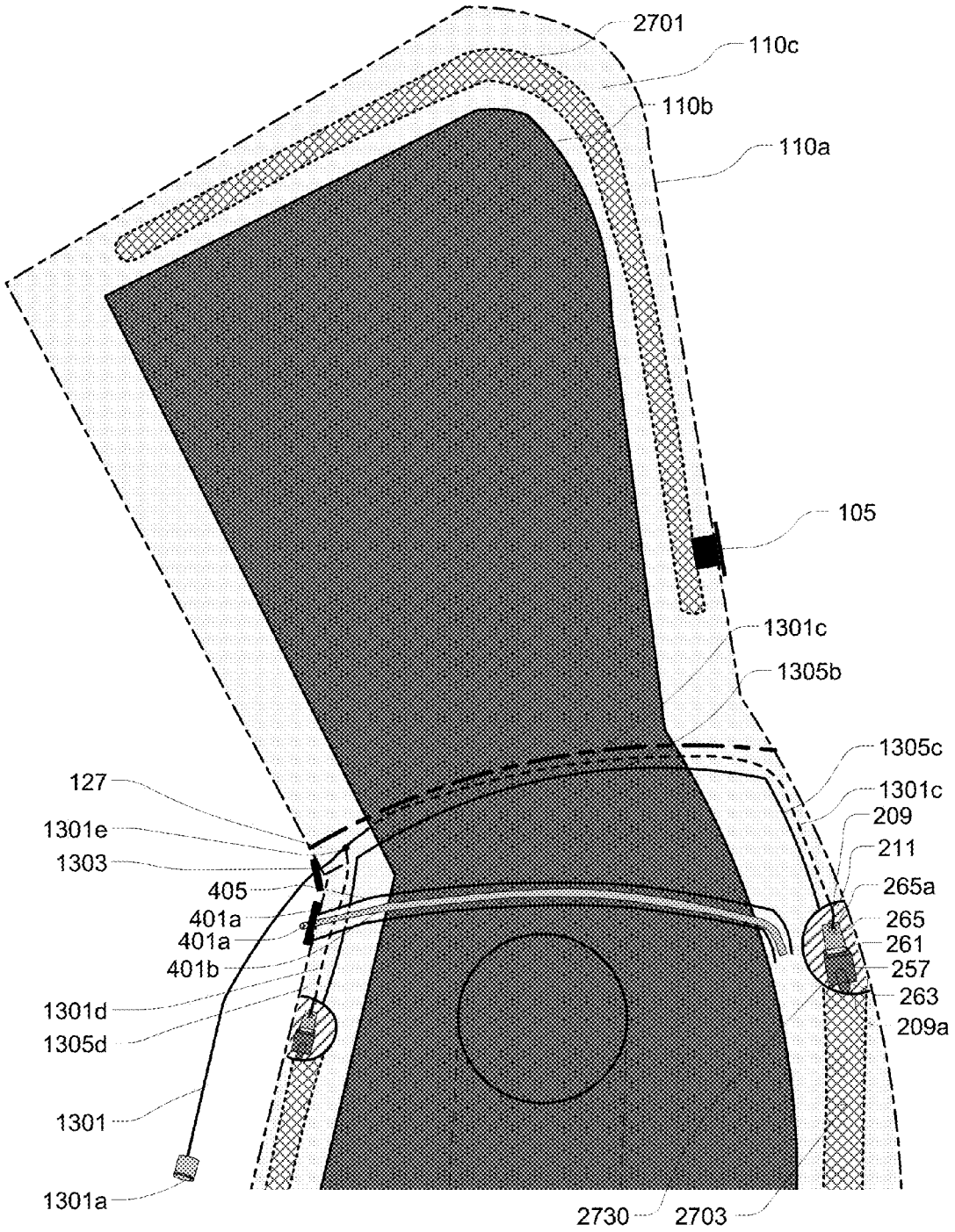
Figure 14:
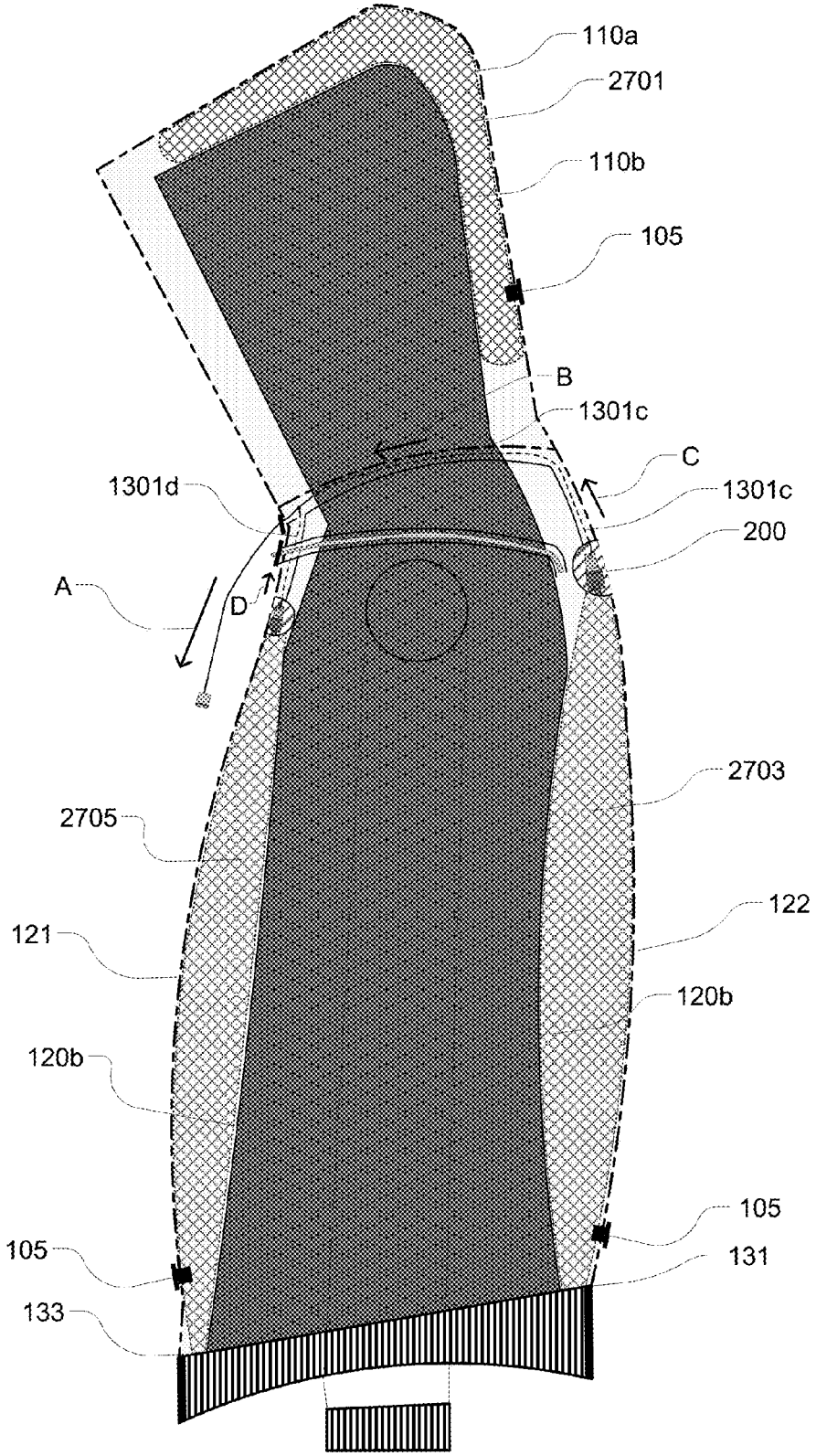
FIG. 14 is a sectional side view of an embodiment of a daily-use garment in an activated state.

As illustrated in FIGS. 11A and 11B, the first manual activation system 1300 in the daily-use garment 2100 also includes a third cord portion 1301*d* extending in a fourth cord passage section 1305*d* in the front side 121 of the body portion 120. The fourth cord passage section 1305*d* extends from the second cord passage 1305*b* to a respective rapid inflation system 200 in the front side 121 of the daily-use garment 2100. The third cord portion 1301*d* connects to a respective manual actuator 265 in the rapid inflation system 200. As illustrated in FIGS. 13A and 13B, the first cord portion 1301*b*, second cord portion 1301*c*, and third cord portion 1301*d* are connected at a joint 1301*e* in the neck space 127. With the joint 1301*e*, when the cord 1301 is pulled in a direction A as illustrated in FIG. 14, the second cord portion 1301*c*, and the third cord portion 1301*d*, are moved in the upward directions C and D. Therefore, as a result of the pull-tabs 1301*a* being pulled in the direction A, respective manual actuator levers 265 are pulled and fluid under pressure is supplied to respective chambers (2701, 2703, 2705), FIG. 14 illustrates the daily-use garment 2100 in an activated state. In the activated state, the large second chamber 2703 expands in an inner space 120*c* in a back side 122 of the daily-use garment 2100, and the third chambers 2705 expand in the front side 122. FIGS. 12A and 12B illustrate the relative size of the large second chamber 2703 of the third inflation system 2700. The large second chamber 2703 in combination with third chambers 2105, will enable the daily-use garment 2100 to maintain a large amount of weight above the surface of a liquid such as water. Thus, the daily-use garment 2100 may be well suited for larger individuals. Further, in the activated state, the daily-use garment 2100 may provide a buoyant object similar to a raft, to which more than one person may hold on to, in order to remain above water.

Obviously, numerous modifications and variations of the present invention are possible in light of the above teachings. It is therefore to be understood that within the scope of the appended claims, the invention may be practiced otherwise than as specifically described herein.

The invention claimed is:

1. A garment with flotation capabilities that masks an appearance of the flotation capabilities when the flotation capabilities are not activated, the garment comprising:

a head portion corresponding to a head region of a wearer, the head portion configured to cover the head region of the wearer;

a body portion corresponding to a torso of the wearer;

a first flexible chamber positioned in the head portion;

a second flexible chamber positioned in the body portion;

a first fluid supply device including a container configured to hold a first fluid under pressure, a first activation member configured to open the container, and one of a conduit and a nozzle that supplies the first fluid from the container; and a pull string including a first end extending from the head portion and a second end attached to an arm of a second activation member of the first fluid supply device, wherein the first activation member automatically opens the container and the first fluid supply device supplies the first fluid to at least one of the first flexible chamber and the second flexible chamber and the garment is converted from a normal state to an activated state, and wherein the wearer pulls the first end of the pull string on an outside of the head portion, the arm is moved by the second end of the pull string, and the container is opened to supply the first fluid.

2. The garment according to claim 1, further comprising a manual conversion mechanism including a conduit having a first opening, a second opening, and a valve within the conduit between the first opening and the second opening, wherein the first opening is accessible from an exterior of the garment and receives a second pressurized fluid from one of the wearer and an external fluid source, and wherein the second pressurized fluid mechanically converts the garment from the normal state to the activated state.

3. The garment according to claim 1, further comprising one of a beacon and a GPS device.

4. The daily-use garment according to claim 1, wherein the first activation member is configured to open the container in response to the first activation member being submerged in a liquid for a predetermined period of time.

5. The garment according to claim 1, further comprising:

a first pressure release valve in the head portion attached to the first flexible chamber and accessible from an exterior side of the garment; and a second pressure release valve in the body portion attached to the second flexible chamber and accessible from the exterior side of the garment.

6. The garment according to claim 1, further comprising:

an outer compartment positioned on an exterior side of the garment and including an access opening and an insulated inner side; and one of a beacon and a GPS device located in an inner compartment formed by a first wall and a portion of the insulated inner side of the outer compartment, wherein the outer compartment is configured to hold at least one of a bottle and a food supply.

7. The garment according to claim 1, further comprising:

a clip attached to an exterior side of the garment; and a detachable compartment attached to the exterior side and including a tether line with a first end attached to an inner side of the detachable compartment and a second end that attaches to the clip;

wherein the detachable compartment is configured to hold at least one of a personal item of the wearer, a flare, a beacon, and a GPS device, and wherein at least one side of the detachable compartment is formed of a reflective material that is more reflective than the exterior side.

8. The garment according to claim 1, further comprising a plurality of reflective strips formed from a first reflective material and attached to the head portion and the body portion on an exterior side of the garment, wherein the exterior side is formed from a second reflective material that is less reflective than the first reflective material.

9. The garment according to claim 1, further comprising a compartment on an interior side of the garment that includes an inlet and an access opening on an exterior side of the garment, wherein the first fluid supply device is positioned in the compartment, and wherein the access opening is opened from the exterior side and the first fluid supply device is removed from the garment.

10. The garment according to claim 1, further comprising:

a first layer forming an inner garment layer of the head portion and the body portion; and a second layer forming an outer garment layer of the head portion and the body portion, wherein the first flexible chamber is positioned in the head portion between the first layer and an interior side of the second layer, and wherein the second flexible chamber is positioned in the body portion between the first layer and the interior side of the second layer.

11. The garment according to claim 10, further comprising:

a third flexible chamber in communication with the at least one of the first flexible chamber and the second flexible chamber; and a second fluid supply device including a tube attached to an opening in the second layer in a front side of the head portion, wherein the tube extends between the first layer and the second layer from the front side of the head portion to a back side of the body portion and into the third flexible chamber, and wherein the tube includes a one-way valve and is configured to receive a second fluid under pressure through the opening and supply the second fluid to the third flexible chamber.

12. The garment according to claim 10, further comprising a compartment including a first wall attached to the interior side of the second layer, wherein the first fluid supply device communicates with an opening in a portion of the first wall of the compartment that forms a portion of a wall of the second flexible chamber.

13. The garment according to claim 12, wherein the first fluid supply device includes the conduit, and wherein the conduit extends through the opening in the portion of the first wall of the compartment that forms the portion of the wall of the second flexible chamber.

14. The garment according to claim 12, wherein the first fluid supply device includes the nozzle, and wherein the nozzle is attached to the opening in the portion of the first wall of the compartment that forms the portion of the wall of the second flexible chamber.

15. The garment according to claim 12, wherein a portion of the second layer forms a second wall of the compartment and includes an inlet opening and access opening, wherein the access opening is configured to be opened and closed from an outside of the second layer for access to the first fluid supply device.

16. The garment according to claim 10, further comprising:

a third flexible chamber positioned in the body portion between the first layer and the interior side of the second layer; and a second fluid supply device including a second container to hold a second portion of the first fluid under pressure, a third activation member configured to open the second container, and a second one of a conduit and a nozzle that supplies the first fluid from the second container, wherein the third activation member automatically opens the second container and the second fluid supply device supplies the first fluid to at least one of the first flexible chamber and the third flexible chamber and the garment is converted from the normal state to the activated state.

17. The garment according to claim 16, further comprising:

a fourth flexible chamber positioned between the first layer and the interior side of the second layer and connected to each of the first flexible chamber, the second flexible chamber and the third flexible chamber;

a first one-way valve positioned in the second flexible chamber upstream of a main body of the second flexible chamber and downstream of a first connection between the second flexible chamber and the fourth flexible chamber;

a second one-way valve positioned in the third flexible chamber upstream of a main body of the third flexible chamber and downstream of a second connection between the third flexible chamber and the fourth flexible chamber; and a third one-way valve positioned in the fourth flexible chamber upstream of the first flexible chamber and downstream of the first connection and the second connection, wherein each of the first fluid supply device and the second fluid supply device is separately configured to fill all of the first flexible chamber, the second flexible chamber, and the third flexible chamber with the first fluid through the fourth flexible chamber.

18. A garment with flotation capabilities that masks an appearance of the flotation capabilities when the flotation capabilities are not activated, the garment comprising:

a head portion corresponding to a head region of a wearer, the head portion configured to cover the head region of the wearer;

a body portion corresponding to a torso of the wearer;

a first flexible chamber positioned in the head portion;

a second flexible chamber positioned in the body portion;

a first fluid supply device including a container configured to hold a first fluid under pressure, a first activation member configured to open the container, and one of a conduit and a nozzle that supplies the first fluid from the container;

a first pressure release valve in the head portion attached to the first flexible chamber and accessible from an exterior side of the garment; and a second pressure release valve in the body portion attached to the second flexible chamber and accessible from the exterior side of the garment, wherein the first activation member automatically opens the container and the first fluid supply device supplies the first fluid to at least one of the first flexible chamber and the second flexible chamber and the garment is converted from a normal state to an activated state.

19. The garment according to claim 18, wherein the first activation member opens the container in response to the first activation member being submerged in a liquid for a predetermined period of time.

20. A garment with flotation capabilities that masks an appearance of the flotation capabilities when the flotation capabilities are not activated, the garment comprising:

a head portion corresponding to a head region of a wearer, the head portion configured to cover the head region of the wearer;

a body portion corresponding to a torso of the wearer;

a first flexible chamber positioned in the head portion;

a second flexible chamber positioned in the body portion;

a first fluid supply device including a container configured to hold a first fluid under pressure, a first activation member configured to open the container, and one of a conduit and a nozzle that supplies the first fluid from the container;

a clip attached to an exterior side of the garment; and a detachable compartment attached to the exterior side and including a tether line with a first end attached to an inner side of the detachable compartment and a second end that attaches to the clip, wherein the first activation member automatically opens the container and the first fluid supply device supplies the first fluid to at least one of the first flexible chamber and the second flexible chamber and the garment s converted from a normal state to an activated state, wherein the detachable compartment is configured to hold at least one of a personal item of the wearer, a flare, a beacon, and a GPS device, and wherein at least one side of the detachable compartment is formed of a reflective material that is more reflective than the exterior side.

* * * * *